US006151048A

United States Patent [19]

Shiozaki

[11] Patent Number: 6,151,048

[45] Date of Patent: Nov. 21, 2000

[54] POWDER-PROJECTING TYPE RECORDING APPARATUS WITH TRANSFER MEDIUM

[76] Inventor: Eini Shiozaki, 103, Higashikanamachi 1-36-3, Katsushika-ku, Tokyo, Japan

[21] Appl. No.: 08/972,240

[22] Filed: Nov. 18, 1997

[30] Foreign Application Priority Data

Nov. 22, 1996 [JP] Japan ..... 8-312436
Mar. 4, 1997 [JP] Japan ..... 9-049271

[51] Int. Cl.[7] ..... B41J 2/04

[52] U.S. Cl. ..... 347/55

[58] Field of Search ..... 347/55, 154, 103, 347/123, 151, 120, 141, 128, 127, 159, 111; 399/271, 290, 292, 293, 294, 297, 302, 308, 288, 251

[56] References Cited

U.S. PATENT DOCUMENTS 5,198,842 3/1993 Fujino et al. ..... 347/154
5,216,453 6/1993 Itoh ..... 347/154
5,477,250 12/1995 Larson ..... 347/55
5,729,817 3/1998 Raymond et al. ..... 347/154
5,774,143 6/1998 Kuehnle et al. ..... 347/154

*Primary Examiner*—John Barlow
*Assistant Examiner*—Raquel Yvette Gordon
*Attorney, Agent, or Firm*—Arent Fox Kintner Plotkin & Kahn

[57] ABSTRACT

Toners 17 supplied from a feed roller 2 of a printing unit 1 and projected through electric field control by a printing control electrodes 20 are accelerated by a voltage applied to a transfer belt 7 from an acceleration voltage source 9. The toners 17 deposited onto the transfer belt 7 by the printing unit 1 moving in the direction vertical to the paper surface are transferred onto recording paper 13 by a fixing device 16 and fixed on the recording paper 13 by heating. Since a toner image is formed on the transfer belt 7, a stable image is formed and it is not easily influenced by the thickness of the recording paper 13 or environment. A plurality of developing agent units 101, 102, 103, and 104 different color toners are used for color printing.

18 Claims, 25 Drawing Sheets

POWDER-PROJECTING TYPE RECORDING APPARATUS WITH TRANSFER MEDIUM

BACKGROUND OF THE INVENTION

1. Field of the Invention

The present invention relates to a powder-projecting type recording apparatus for forming a recording image with a powdered developing agent without forming an electrostatic latent image, particularly to a case of forming a recording image of a plurality of colors.

2. Description of the Related Art

The so-called electrophotographic recording apparatus invented by C. F. Carlson in 1938 has been widely used so far for copying machines, facsimile systems, or printers. The electrophotographic method forms an electrostatic latent image on a photoconductive light-sensitive body. However, the photoconductive light-sensitive body is expensive and a lot of time and expenditure is required to maintain the body. However, Japanese Unexamined Patent Publication JP-A 1-503221(1989) (International Publication WO 89/05231) discloses the prior art for a powder-projecting type recording apparatus capable of directly recording an image on a recording paper by using powdered developing agents without forming an electrostatic latent.

The prior art for the powder projecting method magnetically holds magnetic toner on the surface of a developing roller as developing agents, flies the toner through the electric field control by printing control electrodes set adjacently to the surface of the developing roller, accelerates the toner by applying an acceleration voltage to the printing control electrodes, and making the toner attach onto a recording paper to directly form an image. By performing the electric-field control by the printing control electrode at high accuracy, it is possible to obtain an image with high resolution without forming an electrostatic latent image.

To obtain an image with high resolution by the powder projecting method, high accuracy is required for printing control electrodes. Therefore, a particularly large printing control electrode becomes expensive. Moreover, because a recording member such as a recording paper is inserted between printing control electrodes and a printing acceleration electrode, the projecting states of developing agents are changed due to the thickness of a recording member and thereby, the recording quality of an image may be deteriorated. Furthermore, electrical properties including conductivity of a recording member are changed due to the change of an environment such as humidity and attachment states of a developing agent are changed and thereby, the recording quality of an image is easily deteriorated. Furthermore, because the thickness of a recordable recording member is limited due to the interval between printing control electrodes and a printing acceleration electrode, it is impossible to record an image on a recording member having a thickness exceeding the interval.

These problems are left to powder-projecting type recording arts having been proposed so far as the subjects to be solved. Moreover, the request for easily recording a color image has been intensified.

To obtain an image with high resolution by the powder projecting method, a lot of printing control electrodes 290 are necessary and moreover, it is necessary to increase the density for arrangement on the same flexible printed circuit board (hereafter referred to as "FPC") 291 as shown in FIG. 37. Moreover, the number of driving circuits 294 mounted on a printed circuit board 292 to drive these printing control electrodes 290 at +300 V supplied through a connector 293 increases proportionally to the number of printing control electrodes 290 and many driving circuits 294 are necessary. Because the driving circuit 294 requires a high breakdown voltage because of controlling a high voltage of approx. +300 V, it is impossible to greatly improve the integration degree. Therefore, the cost increases. Therefore, the cost of the driving circuit 294 increases as the resolution rises and thereby, the reliability deteriorates. Furthermore, failure rate of the entire driving circuits 294 increases as the number of the driving circuit 294 increases. Furthermore, a high precision is required of a printing control electrode at high resolution and accordingly the cost increases. Furthermore, in the case of a color image, the number of printing units increases and thus, the cost for the driving circuit 294 further increases.

SUMMARY OF THE INVENTION

It is an object of the invention to provide a powder-projecting type recording apparatus which can be manufactured compactly and inexpensively and which is hardly influenced by changes in environment or recording member and capable of forming a stable image and moreover, easily recording a color image.

It is another object of the invention to provide an inexpensive powder-projecting type recording apparatus with high resolution and reliability.

The invention provides a powder-projecting type recording apparatus comprising:

a printing unit provided with a developing agent carrier for holding powdered developing agents and printing control electrodes for projecting the developing agents through electric field control, the printing unit being capable of reciprocating in a range of a predetermined recording width;

an endless seamless belt-like movable transfer medium having a uniform thickness for accelerating the developing agents supplied by flying from the printing unit to form an image by the developing agents impinging on a surface of the transfer medium;

a fixed base electrode plate set separately from the printing control electrodes at a predetermined interval, for preventing the transfer medium from floating to keep the flatness;

carrying means for carrying the transfer medium in a direction vertical to a moving direction of the printing unit by making the medium synchronize with a movement of the printing unit; and transfer means set at the downstream side of the printing unit about a carrying direction of the transfer medium for transferring the image formed on the surface of the transfer medium with the use of the developing agents, onto a recording member.

According to the invention, an image is formed with the use of the powdered developing agents on the surface of the endless seamless belt-like transfer medium and the image is transferred onto a recording member such as paper by the transfer means. Since the image is formed on the transfer medium having a uniform thickness to which the projected developing agents are accelerated and transferred through the printing control electrodes for projecting the developing agents through electric field control, the image is not easily influenced by changes in environment such as humidity, and therefore it is possible to stably form the image. Since this is an indirect recording system, it is possible to perform preferable recording even on a thick recording member in which the recording quality would be deteriorated in the case of a system of directly forming an image on a recording member with the use of developing agents. Since the printing unit forms an image on the transfer medium with the use of the developing agent while moving, and the carrying means carries the transfer medium in the direction vertical to the moving direction of the printing unit synchronously with the movement of the printing unit. Therefore, it is possible to form a relatively large image with a relatively small printing unit.

The invention is characterized in that the transfer medium is an acceleration electrode which moves and functions as an acceleration electrode for accelerating the projecting developing agents.

According to the invention, since the transfer medium also functions as an acceleration electrode, it is possible to securely attract the developing agents to form an image.

Furthermore, the invention is characterized in that the transfer means transfers and simultaneously fixes the image formed on the transfer medium with the use of the developing agent, onto the recording member by heating and pressuring the developing agent.

According to the invention, it is possible to compactly constitute the entire recording apparatus because the transfer of the image formed with the use of the developing agent from the transfer medium to the recording member and the fixation of the developing agent onto the recording member are simultaneously performed by heating and pressuring the developing agent.

Furthermore, the invention is characterized in that the transfer medium is electrically conductive.

According to the invention, because the transfer medium is electrically conductive, it is possible to easily attach the powdered developing agent electrified before it is flown through electric field control.

The invention is characterized in that the developing agent is a nonmagnetic toner.

According to the invention, since the nonmagnetic toner is used as the developing agent, it is possible to perform recording with preferable coloring.

Furthermore, the invention is characterized in that cleaning means for cleaning an extra developing agent attached to a vicinity of the printing control electrode is provided at an end of a moving range of the printing unit.

According to the invention, it is possible to clean the extra developing agent attached to the vicinity of the printing control electrode by moving the printing unit in its moving range and preferably keep the quality of the image to be recorded.

Furthermore, the invention is characterized in that the cleaning means is a rotating brush roller having a brush made of fiber around the roller and the brush fiber is semiconductive.

According to the invention, it is possible to securely clean the developing agent by the brush made of semiconductive fiber.

Furthermore, the invention is characterized in that the developing agent carrier is provided with:

a hopper for storing the developing agent;

a developing roller for moving the developing agent in the hopper up to a vicinity of the printing control electrode by attaching the developing agent to a surface of the developing roller; and a motor for rotatively driving the developing roller.

According to the invention, it is possible to stably continue to project the powdered developing agent through electric field control because the developing roller is rotated by the motor to move the developing agent stored in the hopper up to the vicinity of the printing control electrode by attaching the developing agent to the surface of the roller. To supply developing agents of a plurality of colors, it is unnecessary to supply a driving force from the outside because the developing agent carrier for each color is provided with the motor for driving the developing roller. Therefore, it is possible to simplify the structure of the printing unit.

Furthermore, the invention is characterized in that the power-projecting type recording apparatus further comprises:

printing control means in which a plurality of sets of the printing units are arranged and printing control electrodes are connected so as to be in parallel in accordance with a predetermined combination between printing units to apply a printing control voltage to every combination of printing control electrodes connected in parallel; and selecting and driving means for selecting a set of developing agent carriers out of the developing agent carriers of a plurality of sets of printing units and applying a bias voltage which allows a developing agent to fly by applying a printing control voltage to a printing control electrode.

According to the invention, color-printing matrix control is realized by setting the bias voltage to be supplied from the selecting and driving means to the developing agent carrier of each printing unit as a voltage necessary for printing densities of different colors and, for example, performing individual connective-intermittent control for each color in accordance with the timing for applying the printing control voltage to the printing control electrode by the printing control means.

Furthermore, a printing control voltage is applied to the printing control electrode from the printing control means for driving the printing control electrode so as to be in parallel with a plurality of developing agent units. Only the same number of driving circuits as that of printing dots of a printing unit are required for the printing control means. For example, when the number of printing dots of a printing unit is 100, 400 printing control electrodes are necessary for four developing agent units in total. In the case of the invention, however, it is enough to drive 100 printing electrodes. That is, even if the number of developing agent units increases, the number of driving circuits does not change. By supplying a developing agent of the same color from a plurality of developing agent units and shifting the position of a printing control electrode, it is possible to improve the resolution of an image to be printed.

Selection between different developing agent units is performed in accordance with a bias voltage to be applied to a developing agent carrier from selecting and driving means. That is, control of the developing agent for each printing dot is performed by selectively flying the developing agent in accordance with a combined matrix between application of a bias voltage to a developing agent carrier and application of a printing control voltage to a printing control electrode and accelerating the developing agent in accordance with an acceleration voltage to printing acceleration means. By making the bias voltage of the developing agent carrier approach the printing control voltage of a printing control electrode, the amount of the developing agent to be flown decreases. However, by making the bias voltage keep away from the printing control voltage, the amount of the developing agent to be flown increases and the image strength of the printing dot on the image forming medium increases.

Furthermore, the invention is characterized in that developing agent units for four colors of cyan, magenta, yellow, and black are arranged on the printing unit in a 2×2 matrix form as a whole so that two units are arranged in the moving direction and two units in the direction vertical to the moving direction.

According to the invention, by supplying developing agents onto the transfer medium from the developing agent units for the four colors of cyan, magenta, yellow, and black, it is possible to form an image consisting of two colors on the transfer medium by moving the printing unit once and moreover form a full-color image on the medium by moving the printing unit twice because the two developing agent units are arranged in the moving direction.

Furthermore, the invention is characterized in that a total of six developing agent units for four colors of cyan, magenta, yellow and black are arranged in the printing unit of the invention in two lines in the moving direction separately from each other so that three units are arranged in each line, and cyan, magenta, and yellow are assigned to the three units of one of the two lines, respectively, and black is assigned to three units of the other line.

According to the invention, in the case of the developing agent unit arrangement in a matrix form of 2 lines×3 units, three units of one line serve as developing agent units for three colors and three units of the other line all serve as developing agent units of black. Thereby, three repetitions of black printing are realized by one time of printing unit reciprocation and accordingly a faster apparatus is realized.

Furthermore, the invention is characterized in that the printing control electrodes of the plurality of sets of the printing units are formed on the same printed circuit board and the printing control means is mounted on the printed circuit board.

According to the invention, printing control electrodes are connected in parallel on the same printed circuit board in accordance with the combination between preset developing agent units and printing control means for applying the printing control voltage to each combination between the printing control electrodes connected in parallel is mounted. Printing control electrodes are connected in parallel with a plurality of sets of developing agent units but only the same number of driving circuits as that of printing dots are required for the printing control means. Therefore, it is possible to decrease the printed circuit board not only in area, but also in wiring density.

As described above, the apparatus of the invention forms an image on the surface of the endless seamless belt-like transfer medium with the use of the powdered developing agent and performs indirect recording in which the image is transferred onto a recording member such as paper by the transfer means. Therefore, the image is not easily influenced by changes in environment such as humidity and it can be preferably recorded in a thick recording member, in which the recording quality would be deteriorated in the case of a system of directly forming an image on a recording member. The printing unit forms an image on a transfer medium with the use of a developing agent and carries the transfer medium in the direction perpendicular to the moving direction of the printing unit synchronously with the movement of the printing unit. Therefore, it is possible to downsize the printing unit and reduce the manufacturing cost.

Furthermore, according to the invention, since the developing agent is heated and pressured at the same time when transferring an image formed with the use of the developing agent to the recording member from the transfer medium, it is possible to securely fix the developing agent on the recording member.

Furthermore, according to the invention, since the transfer medium is electrically conductive, it is possible to improve the adhesive property to an electrified powdered developing agent.

Furthermore, according to the invention, since nonmagnetic toner is used as a developing agent, it is possible to perform recording under a preferable coloring condition.

Furthermore, according to the invention, it is possible to clean an extra developing agent attached to the vicinity of the printing control electrode by moving the printing unit to an end of the moving range. Thus, since a clean printing control electrode is used, it is possible to keep the quality of an image to be recorded preferable.

Furthermore, according to the invention, since the developing agents of different colors are supplied from the printing unit, it is possible to easily perform recording in which a plurality of colors are used. Since the developing agent attached to the surface of a transfer medium is powdered, it is possible to transfer the developing agents of a plurality of colors at the time of transfer from the transfer medium to the recording member by the transfer means by mixing the developing agents of different colors.

Furthermore, according to the invention, since the developing agent units for the four colors of cyan, magenta, yellow and black are arranged in the 2×2 matrix form, it is possible to make the printing unit compact. When supplying the developing agents onto the transfer medium, it is possible to form an image of two colors by moving the printing unit once, and moreover, to easily form a full-color image by moving the printing unit twice because developing agents of two colors are arranged in the moving direction.

Furthermore, according to the invention, the printing unit makes it possible to stably continue the flying of the powdered developing agent through the electric field control by rotatively driving the developing roller by the motor, attaching the developing agent stored in a hopper to the surface of the roller, and moving the roller up to the vicinity of the printing control electrode. Particularly, to supply the developing agents of plurality of colors, it is possible to simplify the structure of the printing unit because the developing agent carrier for each color is provided with the motor for rotatively driving a developing roller, and thereby it is unnecessary to supply a driving force from the outside.

Furthermore, according to the invention, the printing control voltage is applied to the printing control electrodes of the plurality of developing agent units in parallel and the printing dots are determined as a matrix combined with selection of the developing agent carrier by selecting and driving means. Therefore, only the same number of driving circuits as that of printing dots are required for the printing control means. Therefore, even if the number of printing dots increases in order to obtain a high resolution apparatus, it is possible to perform inexpensive and high reliability powder-flying type recording.

Furthermore, according to the invention, inexpensive and highly reliable powder-projecting type recording is realized by the color-printing matrix control.

Furthermore, according to the invention, three repetitions of black printing can be made by one time of printing unit reciprocation with the result that a faster or higher resolution apparatus is realized.

Furthermore, according to the invention, even in high resolution printing or color printing, it is possible to obtain a high reliability and low cost apparatus with a printed circuit board having a reduced area and a smaller wiring density.

Furthermore, according to the invention, since the powdered developing agent to be flown from the printing unit stably forms an image by attaching to the surface of a transfer medium having a uniform thickness, it is possible to transfer and record the image to and in various recording media. By forming an image with the use of the developing agents of the plurality of colors, it is possible to transfer the developing agents of the plurality of colors at the same time.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
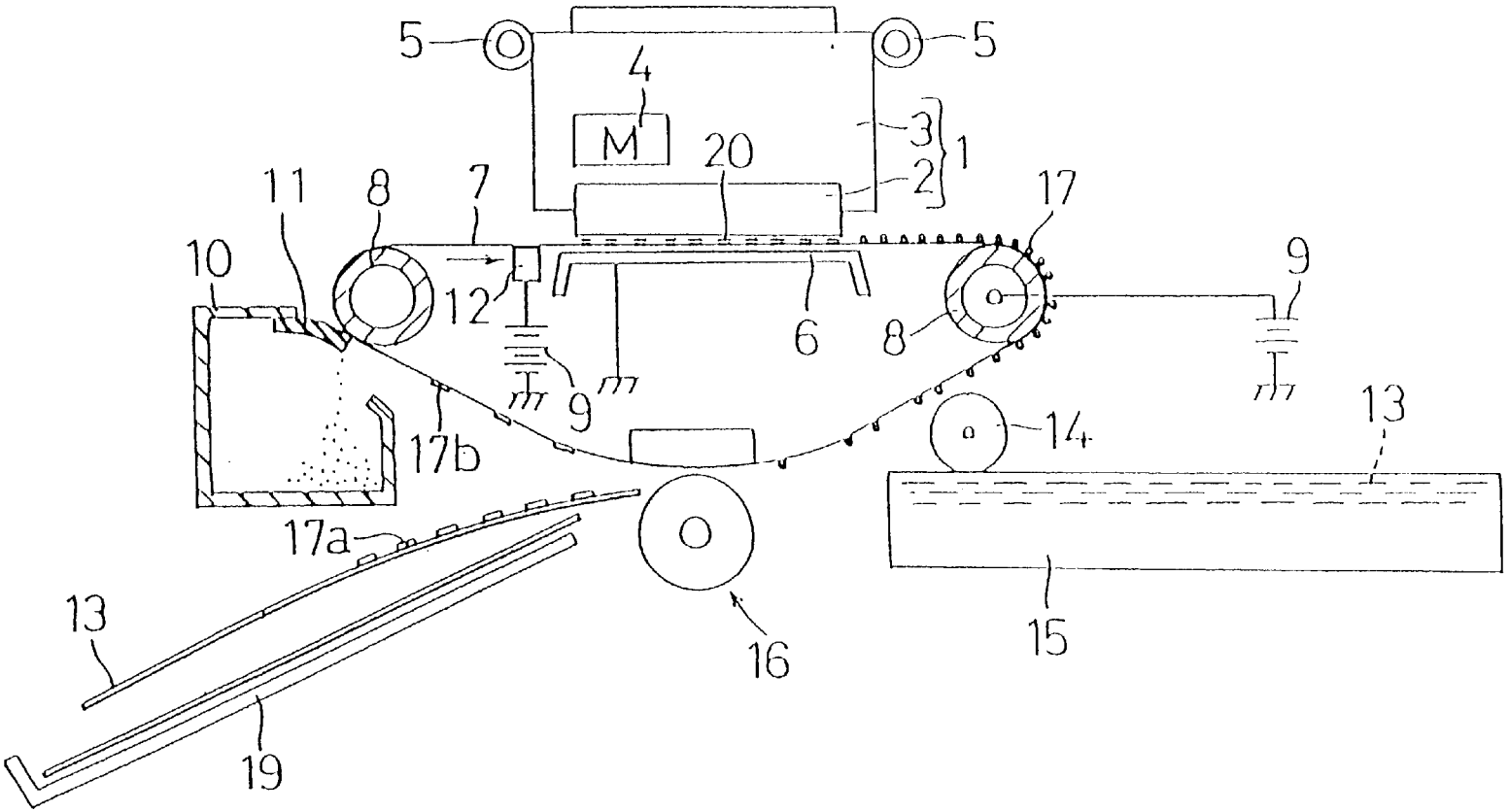
FIG. 1 is a simplified right-side sectional view showing a schematic structure of a powder-flying type recording apparatus of an embodiment of the present invention.

Now referring to the drawings, preferred embodiments of the invention are described below.

Each drawing shows the side for carrying and taking out a recording paper as the front side. A portion already described in preceding drawings and a portion corresponding to the portion in the following drawings are provided with the same symbol and duplicated description is omitted.

FIG. 1 shows a schematic structure of a powder-flying type recording apparatus of an embodiment of the present invention viewed from the right side of the apparatus. In the case of this embodiment, a printing unit 1 uses the shuttle type capable of reciprocating in the direction vertical to the paper surface. The printing unit 1 is provided with a developing roller 2 and a toner vessel 3 as developing agent carriers. A motor 4 for rotatively driving the developing roller 2 is set in the toner vessel 3. The printing unit 1 moves along a guide shaft provided vertically to the paper surface. A base electrode plate 6 is set below the developing roller 2 at an interval along the moving direction of the printing unit 1. A transfer belt 7 is inserted between the developing roller 2 and the base electrode plate 6. The transfer belt 7 is made of polyimide of high heat resistance and stretched between support rollers 8.

The base electrode plate 6 is connected to GROUND in order to electrostatically attract the transfer belt 7. A DC voltage of approx. +1,500 V is applied to the transfer belt 7 from an acceleration voltage source 9.

The transfer belt 7 is carried in the cross direction in FIG. 1 and a belt cleaning unit 10 for the transfer belt 7 is set to the upstream side of the printing unit 1 and the base electrode plate 6. The belt cleaning unit 10 includes a cleaning blade 11. The DC voltage supplied from the acceleration voltage source 9 is applied to the transfer belt 7 through an acceleration voltage electrode 12. Below the printing unit 1 and the base electrode 6, recording papers 13 serving as recording members are taken out of a feed tray 15 by a pickup roller 14 one by one and toner 17 attached onto the transfer belt 7 is transferred to the paper 13 at the portion of a fixing device 16.

The toner 17 is powder using a thermoplastic resin containing a pigment as the main component. The thermoplastic resin is fused by heating it with a fixing device and transferred as a toner image 17*a* by bringing the recording paper 13 into close contact with the transfer belt 7. Some of the fused toner 17 may remain on the transfer belt 7 as deposited toner 17*b*.

The belt cleaning unit 10 removes the deposited toner 17*b* still remaining after transferred. The toner 17 which is a powdered developing agent flown from the printing unit 1 through electric field control is attached onto the cleaned transfer belt 7 to form an image to be recorded and transfer a toner image onto the recording paper 13 by the fixing device 16. The recording paper 13 to which the toner image is transferred and in which the image is recorded is stored in a paper tray 19. A printing control electrode 20 for electric-field-controlling the flying of the toner 17 is set between the developing roller 2 and the transfer belt 7 at the bottom of the printing unit 1.

Figure 2:
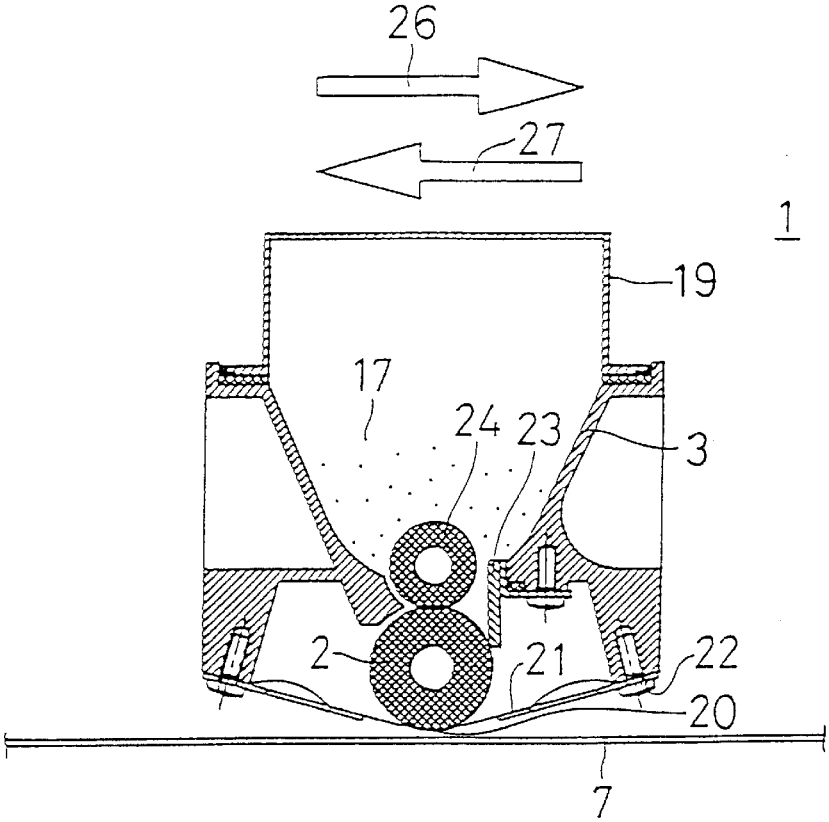
FIG. 2 is a front sectional view sowing a schematic structure of a printing unit 1 of the embodiment in FIG. 1.

FIG. 2 shows a schematic structure of the printing unit 1 in FIG. 1. The printing control electrode 20 set to the bottom of the printing unit 1 is formed on the surface of a flexible printed circuit board (hereafter referred to as "FPC") 21. The FPC 21 is secured to the toner vessel 3 by a bolt 22. The developing roller 2 is set so as to face the opening at the bottom of the toner vessel 3 to supply the toner 17 attached to the surface to the vicinity of the printing control electrode 20. The toner 17 is controlled by a doctor blade 23 so that the attached amount of the toner 17 does not excessively increase. A feed roller 24 is set in the toner vessel 3 so that the toner 17 is smoothly supplied to the surface of the developing roller 2. The top of the toner vessel 3 storing the toner 17 is closed with a cover 19. The printing unit 1 can reciprocate in the moving directions 26 and 27 which is the cross direction in FIG. 2 while controlling the printing control electrode 20 and the transfer belt 7 so that a predetermined interval is kept between the electrode 20 and the belt 7.

Figure 3:
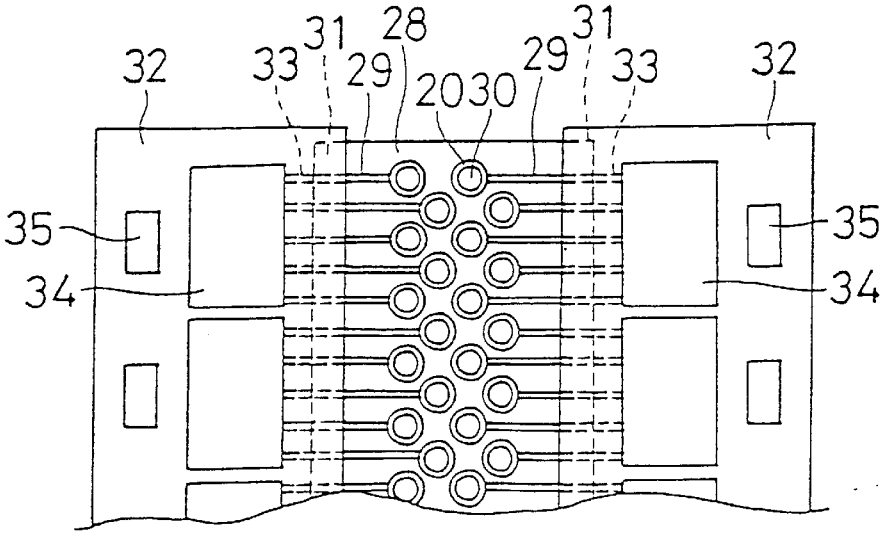
FIG. 3 is a partial plan view of a printing control electrode 20 in FIG. 2.

FIG. 3 shows a partial structure of the printing control electrode 20 in FIG. 2. The printing control electrode 20 is electrically connected to a connective pattern 29 on a flexible insulating substrate 28 composed of a film made of a heat-resistant electrical insulating material such as polyimide, and formed so as to enclose the circumference of a through-hole 30 having a diameter through which the toner 17 can pass. The connective pattern 29 is electrically connected with a wiring pattern 33 formed on a printed circuit board 32 made of glass epoxy through an anisotropic conductive film 31. A driving circuit 34 for driving the printing control electrode 20 by applying a bias voltage of 0 to +300 V for electric field control to the electrode 20 and a circuit component 35 such as a bypass capacitor are mounted on the printed circuit board 32. The driving circuit 34 is fabricated so as to be of high breakdown voltage as a semiconductor integrated circuit chip.

Figure 4:
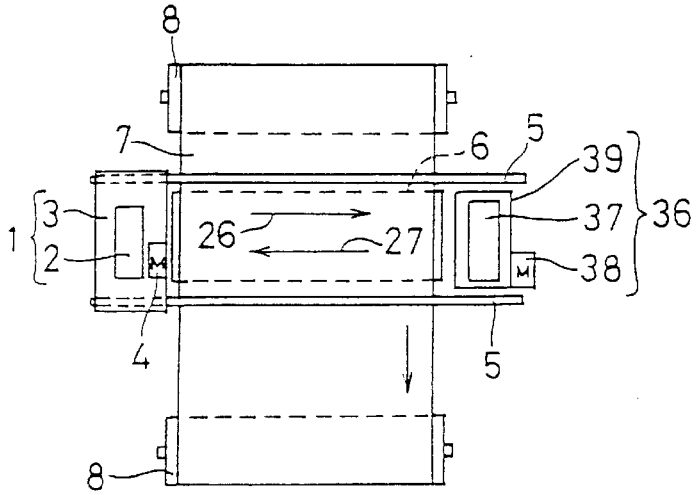
FIG. 4 is a plan view showing a schematic structure of the embodiment in FIG. 1.

FIG. 4 shows a schematic plane structure of the embodiment in FIG. 1. The printing unit 1 can reciprocate in the moving directions 26 and 27 along the guide shaft 5. The transfer belt 7 is carried between the support rollers 8 in the direction perpendicular to the moving direction of the printing unit 1. The head cleaning unit 36 for the developing roller 2 is set to one end of the moving range of the printing unit 1, and a cleaning roller 37 and a cleaner motor 38 for rotatively driving the roller 37 are set to a vessel 39. By moving the printing unit 1 up to the position of the cleaning unit 36 at a predetermined frequency of recording an image on one recording paper 13 and removing the toner 17 from the vicinity of the control electrode 20, it is possible to keep the vicinity of the control electrode 20 clean.

Figure 5A:
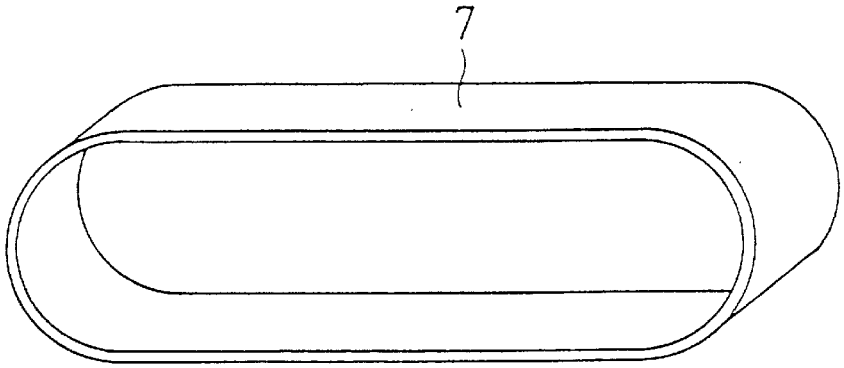
FIG. 5A is a perspective view of a transfer belt 7 in FIG. 1.
Figure 5B:
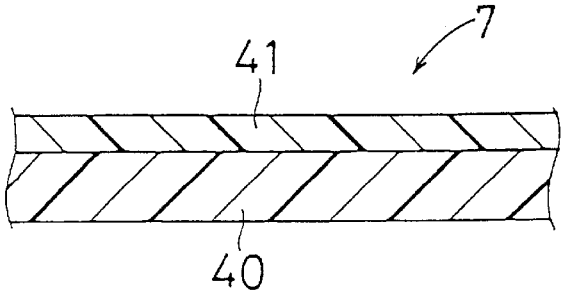
FIG. 5B is a partial sectional view of the transfer belt 7 in FIG. 1.

FIGS. 5A and 5B show structures of the transfer belt 7 in FIG. 1. As shown by a perspective view in FIG. 5A, the transfer belt 7 is formed to be endless, seamless, and annular. As shown by a partial sectional view in FIG. 5B, it is preferable to form a mold release layer 41 made of polytetrafluoroethylene (hereafter referred to as "PTFE") resin referred to as "Teflon" by its trade name on the surface of a heat-resistant film 40 made of polyimide serving as a material. It is more preferable that the heat-resistant film 40 has a thickness of 30 to 80 $\mu$m and a conductivity of $10^3$ to $10^5$ Ωcm because the adhesive property of electrified toner is improved. By forming the mold release layer 41, it is possible to smoothly transfer toner. Moreover, it is also preferable that the mold release layer 41 is electrically conductive because the adhesive property of toner due to acceleration of the toner is improved.

Figure 6:
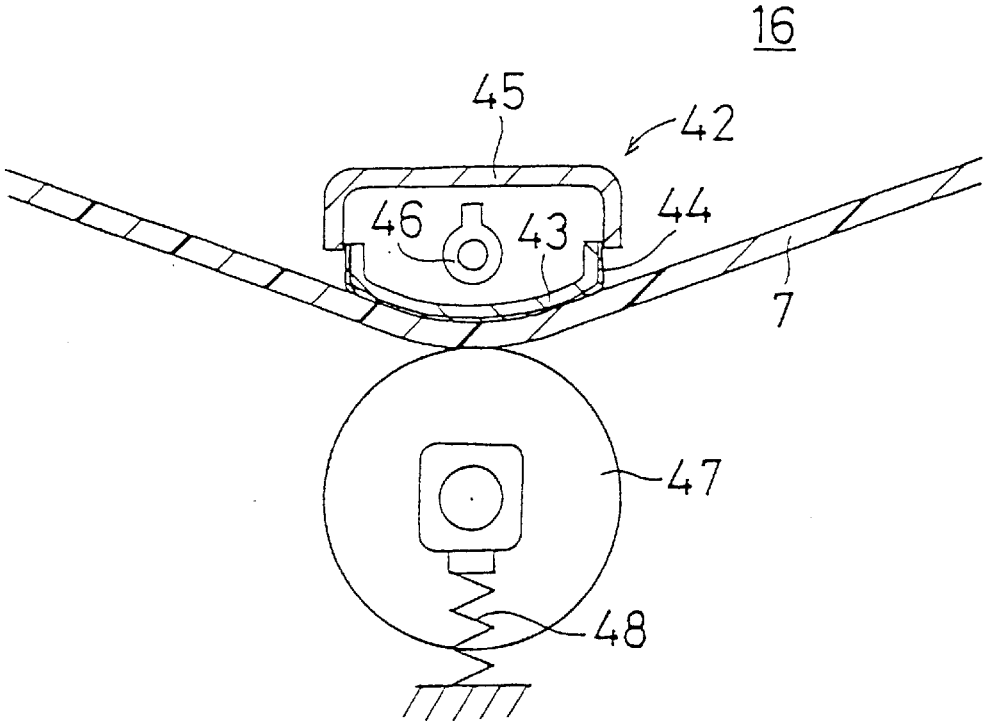
FIG. 6 is a side sectional view of a fixing device 16 in FIG. 1.

FIG. 6 shows a structure of the fixing device 16 of the embodiment in FIG. 1. The fixing device 16 has a heater 42, fuses the toner attached to the surface of the transfer belt 7 by heating the toner, and transfers the toner to a recording paper or the like. The bottom of the heater 42 is formed with a metallic plate 43 made of aluminum of high heat conductivity. The surface of the metallic plate 43 is formed with a surface coat 44 made of materials having good heat-resistance and mold releasability such as PTFE. A cover 45 is set to the top of the heater 42 and a halogen lamp 46 is set in the heater 42 as a heating source. A rubber roller 47 is set below the heater 42 to urge the roller 47 in the rising direction by a pressure spring 48. The fixing device 16 makes it possible to transfer and fix a toner image on the intermediate belt 7 onto a recording paper by holding the recording paper between the intermediate roller 7 and the rubber roller 47 to pressure the paper and moreover heating the paper with the heater 42. Because the rubber roller 47 is pressured by the pressure spring 48, it is possible to transfer the toner image at excellent follow-up quality even if the thickness of a paper inserted between the transfer belt 7 and the rubber roller 47 fluctuates. Particularly, it is possible to transfer the toner image even to a thick recording member having a large thickness change such as an envelope at a preferable recording quality. Moreover, because the toner image is formed on the transfer belt 7 for a material different from paper such as a film for a manuscript of an overhead projector (O.H.P.), the material quality does not greatly influence image formation and therefore, it is possible to perform stable recording.

Figure 7:
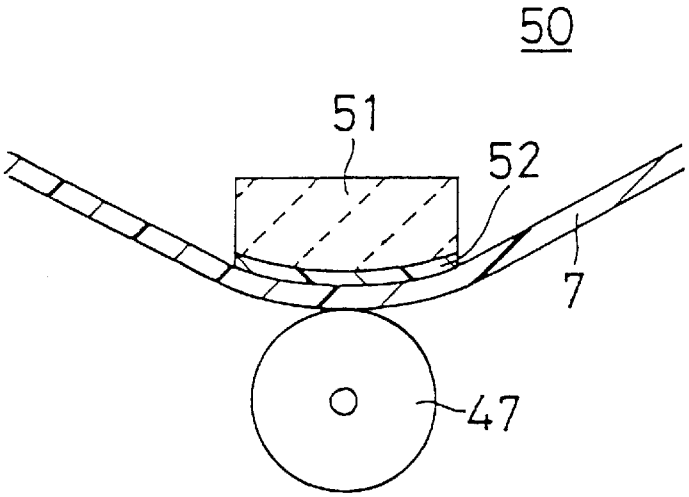
FIG. 7 is a front sectional view of a fixing device 50 of another embodiment of the present invention.
Figure 8:
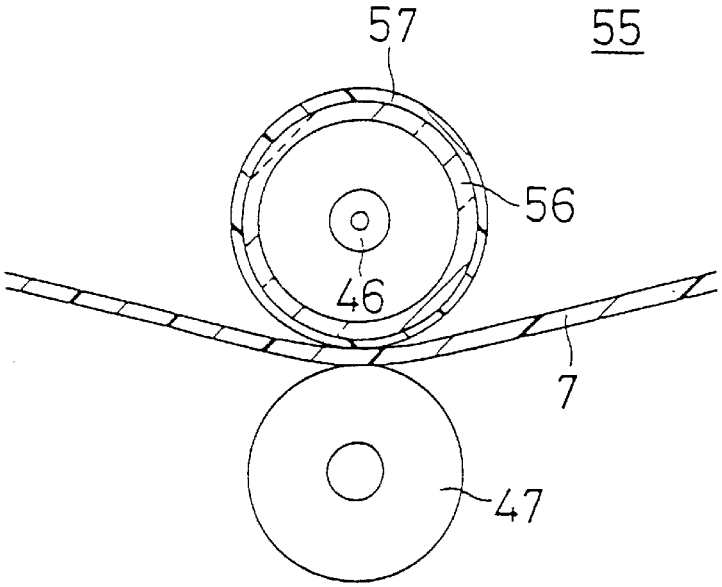
FIG. 8 is a front sectional view of a fixing device 55 of still another embodiment of the present invention.

FIGS. 7 and 8 show a schematic structure of a fixing device of another embodiment of the present invention. Structures of other portions are the same as those of the embodiment in FIG. 1. In the case of a fixing device 50 in FIG. 7, the rise characteristic for temperature rise under heating is improved by using a rod-like ceramic heater 51. The surface of the ceramic heater 51 is provided with a surface coat made of PTFE or the like as an insulating thin film 52 to decrease the friction with the transfer belt 7. In the case of a fixing device 55 in FIG. 8, a surface coat 57 made of PTFE or the like is formed on the outer periphery of a fixed glass tube 56 to decrease the friction with the intermediate belt 7. The halogen lamp 46 is set in the glass tube 56 as a heating source.

Figure 9:
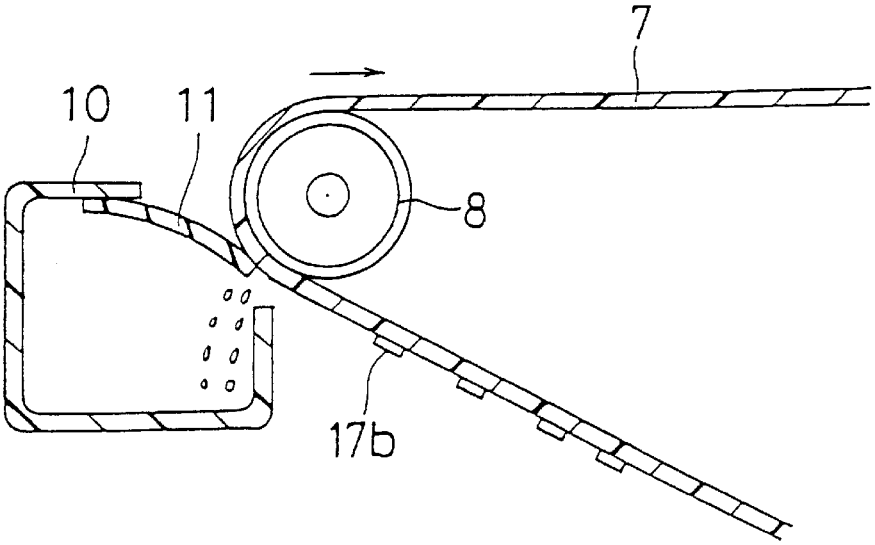
FIG. 9 is a front sectional view of a cleaning unit 10 of the embodiment in FIG. 1.

FIG. 9 shows a structure of the cleaning unit 10 in FIG. 1. The cleaning unit 10 is provided with a blade 11 to remove the residual toner 17*b* from the surface of the transfer belt 7 by scraping away the toner 17*b* with the edge of the blade 11. It is preferable to use hard conductive rubber as the material of the blade 11.

Figure 10:
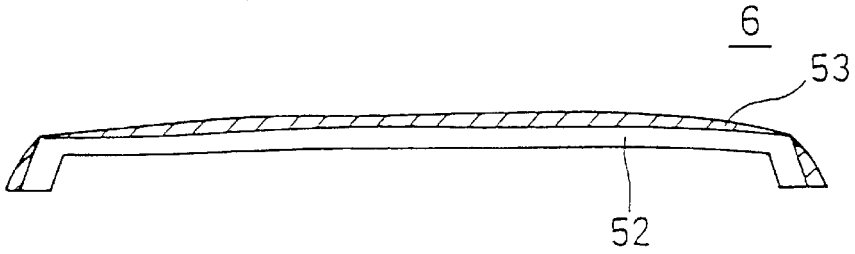
FIG. 10 is a sectional view of a base electrode 6 in FIG. 1.

FIG. 10 shows the structure of the base electrode 6. An electrode 52 serving as a base is made of a metal and the surface is covered with an insulating thin film 53 made of Teflon or the like.

Figure 11A:
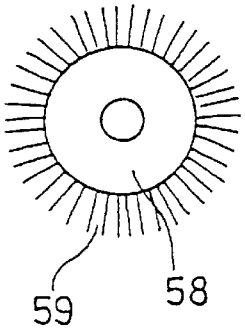
FIGS. 11A and 11B are a left-side view and a perspective view showing a cleaning roller 37 in FIG. 4.
Figure 11B:
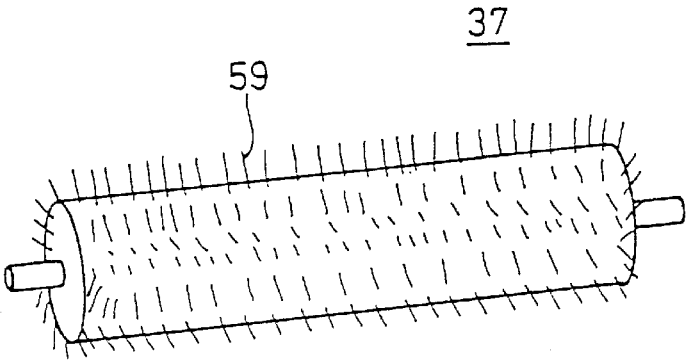

FIG. 11 shows the structure of the cleaning roller 37. A roller 58 is made of a metal. A semi-conductive brush 59 is obtained by electrostatically flocking very fine nylon fibers having a length of 1 to 3 mm on the outer periphery of the roller 58 and these fibers further have a conductive characteristic of $10^2$ to $10^6$. Moreover, the roller 58 is electrically connected with the semi-conductive brush 59.

Figure 12:
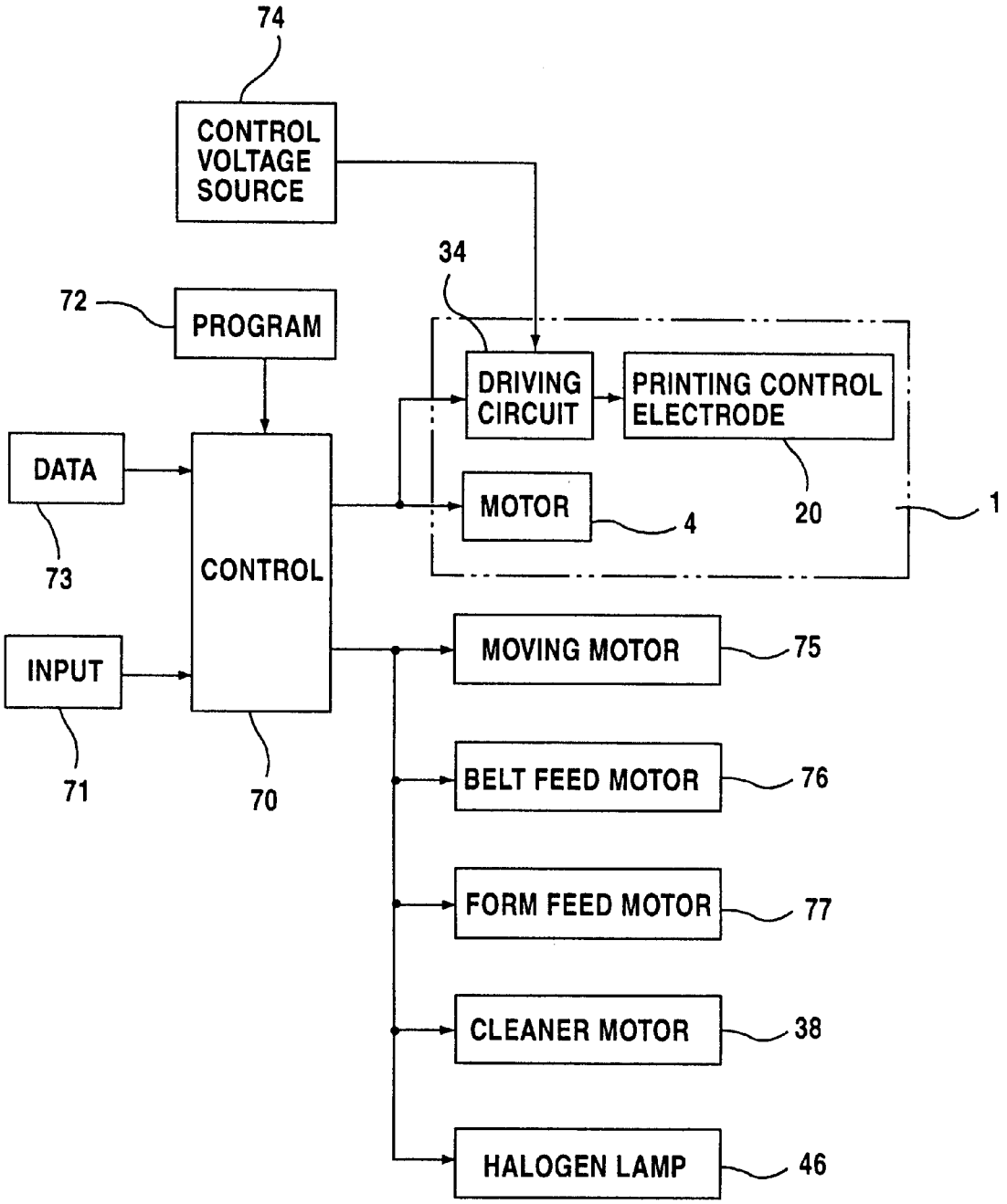
FIG. 12 is a block diagram showing a schematic electrical structure of the embodiment in FIG. 1.

FIG. 12 shows a schematic electrical structure of the embodiment in FIG. 1. A control circuit 70 including a microcomputer and the like supplies the data stored in a data memory 73 to the driving circuit 34 of the printing unit 1 in accordance with a command to be supplied to an input device 71 such as an operation switch and a program previously stored in a program memory 72. The driving circuit 34 changes a voltage of approx. +300 V supplied from a control voltage source 74 in accordance with data and applies a changed voltage to the printing control electrode 20 to electrical-field-control a toner flying state. Moreover, the control circuit 70 drives a moving motor 75 for moving the printing unit 1, belt feed motor 76 for carrying the transfer belt 7, paper feed motor 77 for carrying the recording paper 13, cleaner motor 38 for cleaning a developing roller, halogen lamp 46 for heating the fixing device 16, and motor 4 for rotating the developing roller 2 of the printing unit 1. Operations between the motors and the halogen lamp are synchronized in accordance with a program. The movement of the printing unit 1 by the moving motor 75 is performed by a driving belt stretched along the guide shaft 5 shown in FIG. 1. The moving motor 75, belt feed motor 76, and form feed motor 77 respectively use, for example, a stepping motor and control an angular displacement value as digital data. The movement of the printing unit 1 to a specific position such as an origin or a position of the head cleaning unit 36 shown in FIG. 4 is also detected by a previously-set sensor such as an optical interrupter.

Figure 13:
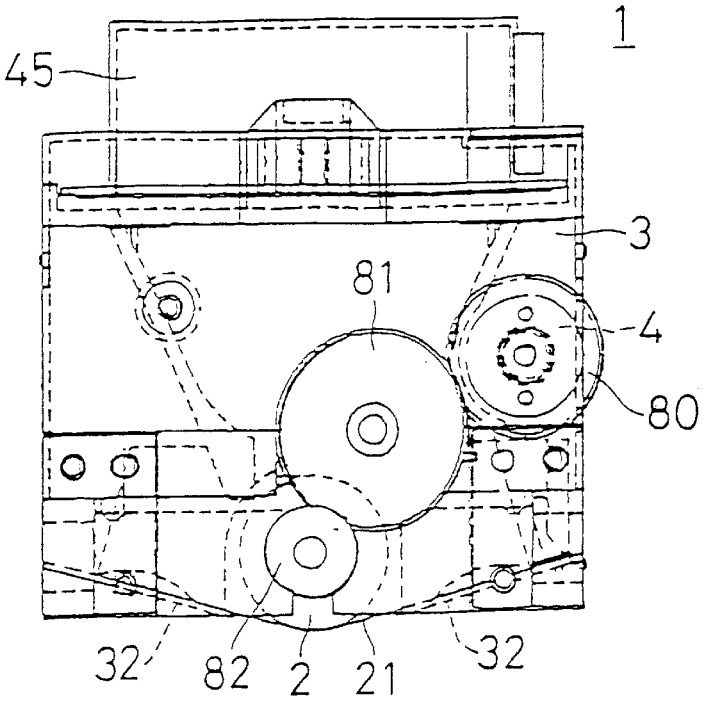
FIG. 13 is a front view of the printing unit 1 of the embodiment in FIG. 1.
Figure 14:
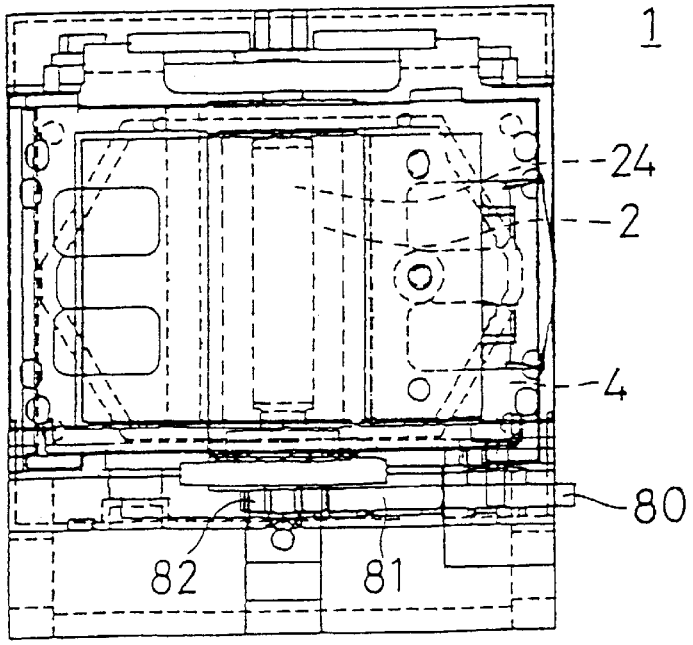
FIG. 14 is a plan view of the printing unit 1 of the embodiment in FIG. 1.
Figure 15:
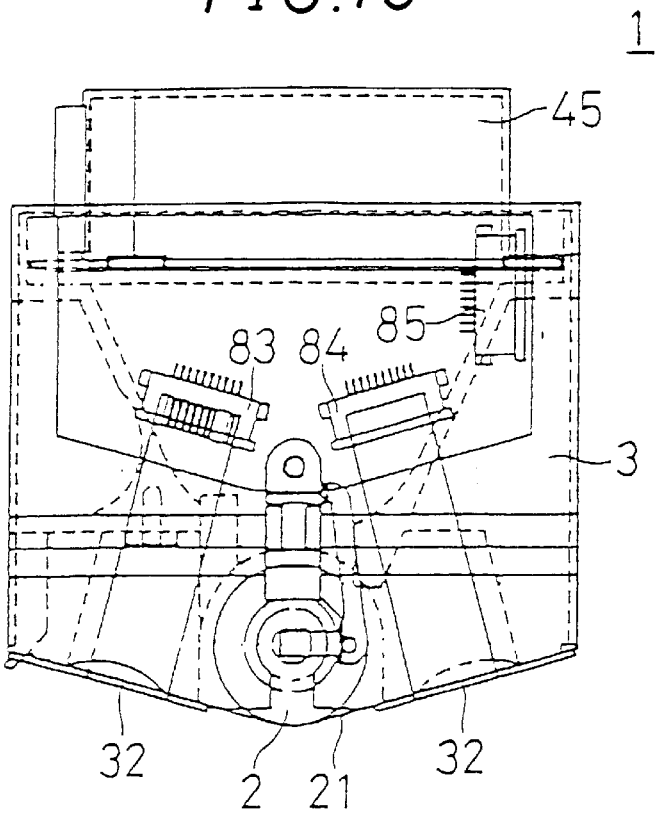
FIG. 15 is a back view of the printing unit 1 of the embodiment in FIG. 1.

FIGS. 13, 14, and 15 show a front view, plan view, and back view of the printing unit 1 of the embodiment in FIG. 1 respectively. The rotatively driving force supplied from the motor 4 set to the toner vessel 3 is transmitted to a gear 82 set to one end of the rotary shaft of the developing roller 2 from a gear 80 set to the rotary shaft of the motor 4 through an intermediate gear 81. The printing unit 1 is electrically connected with external units through connectors 83, 84, and 85.

Figure 16:
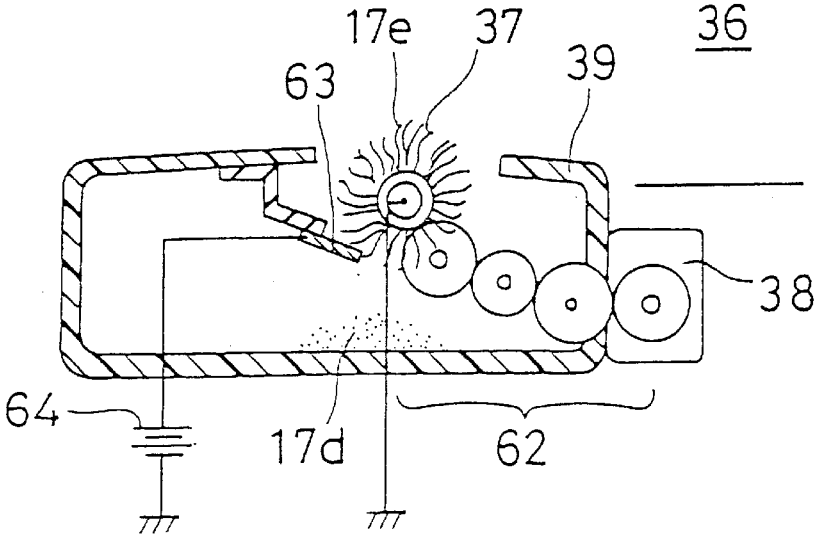
FIG. 16 is a front view of a cleaning unit 36 of the embodiment in FIG. 1.

FIG. 16 shows the structure of the head cleaning unit 36. The cleaning brush roller 37 is set to the cleaner vessel 39 and used toner 17*c* is removed from the cleaning brush roller 37 by a cleaner brush 63. The cleaning brush roller 37 is made by attaching fibers obtained by applying conductive treatment to nylon fibers to the surface of a metallic roller and a resistance of $10^2$ to $10^6$ is provided between the metallic roller and the fibers. When the printing unit 1 comes to the position of the head cleaning unit 36, the cleaning brush roller 37 is rotatively driven by the motor 38 through a gear train 62 to scrape away the toner from the surface of the FPC. Therefore, the front end of the brush roller 37 is set to a height for slightly contacting the surface of the FPC (approx. 2 mm in terms of fiber length).

Moreover, to clean the brush roller 37, the cleaning brush 63 contacts the brush roller 37 and removes the toner 17*e*. Therefore, the cleaning brush 63 is set by applying a voltage to the brush 63 from a cleaning voltage source 64. The voltage supplied from the cleaning voltage source 64 ranges between +1,000 and +1,500 V. The removed toner 17*e* is discarded as used toner 17*d*.

Figure 17:
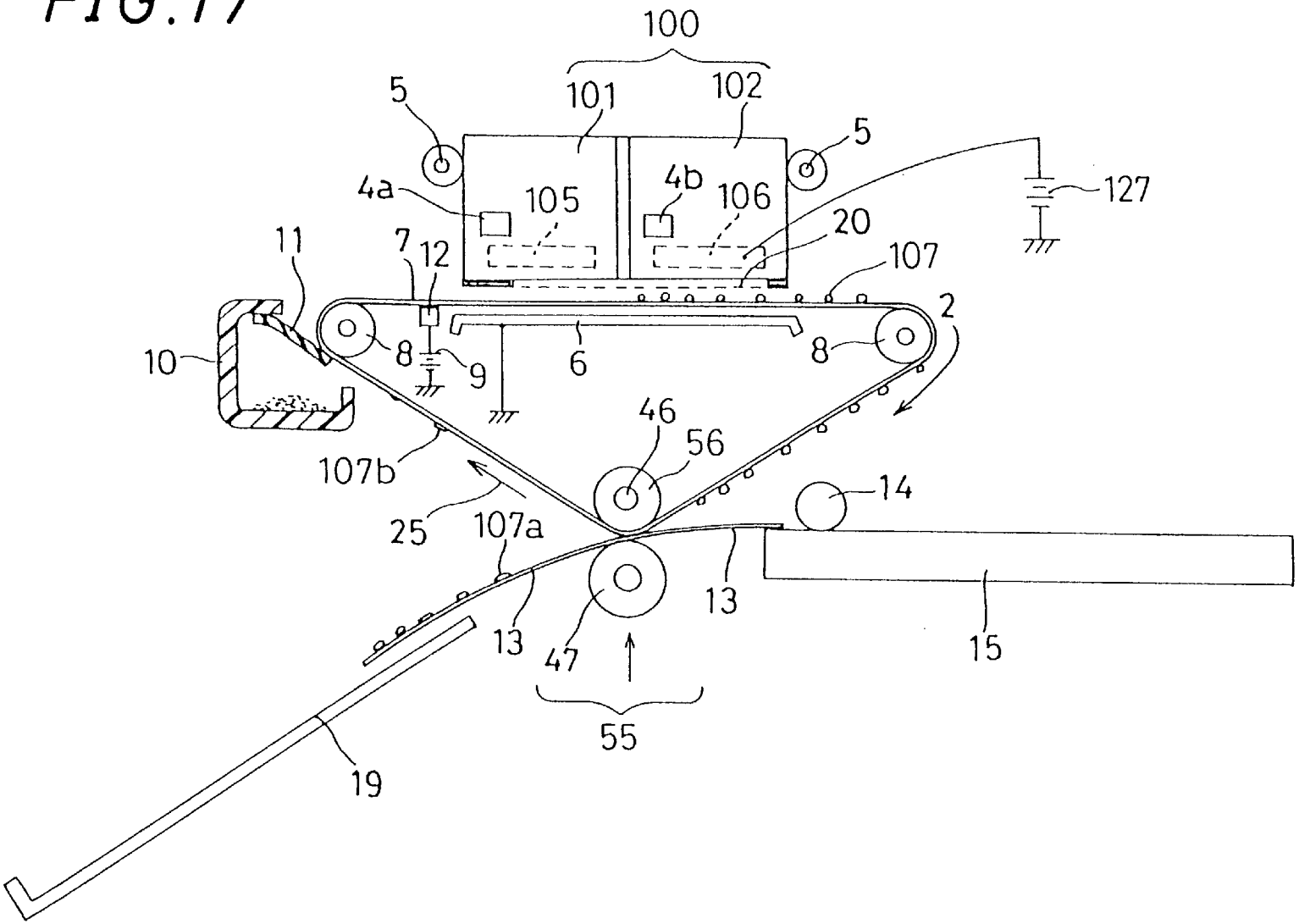
FIG. 17 is a simplified right-side sectional view showing a schematic structure of a powder-flying type recording apparatus of still another embodiment of the present invention.
Figure 18:
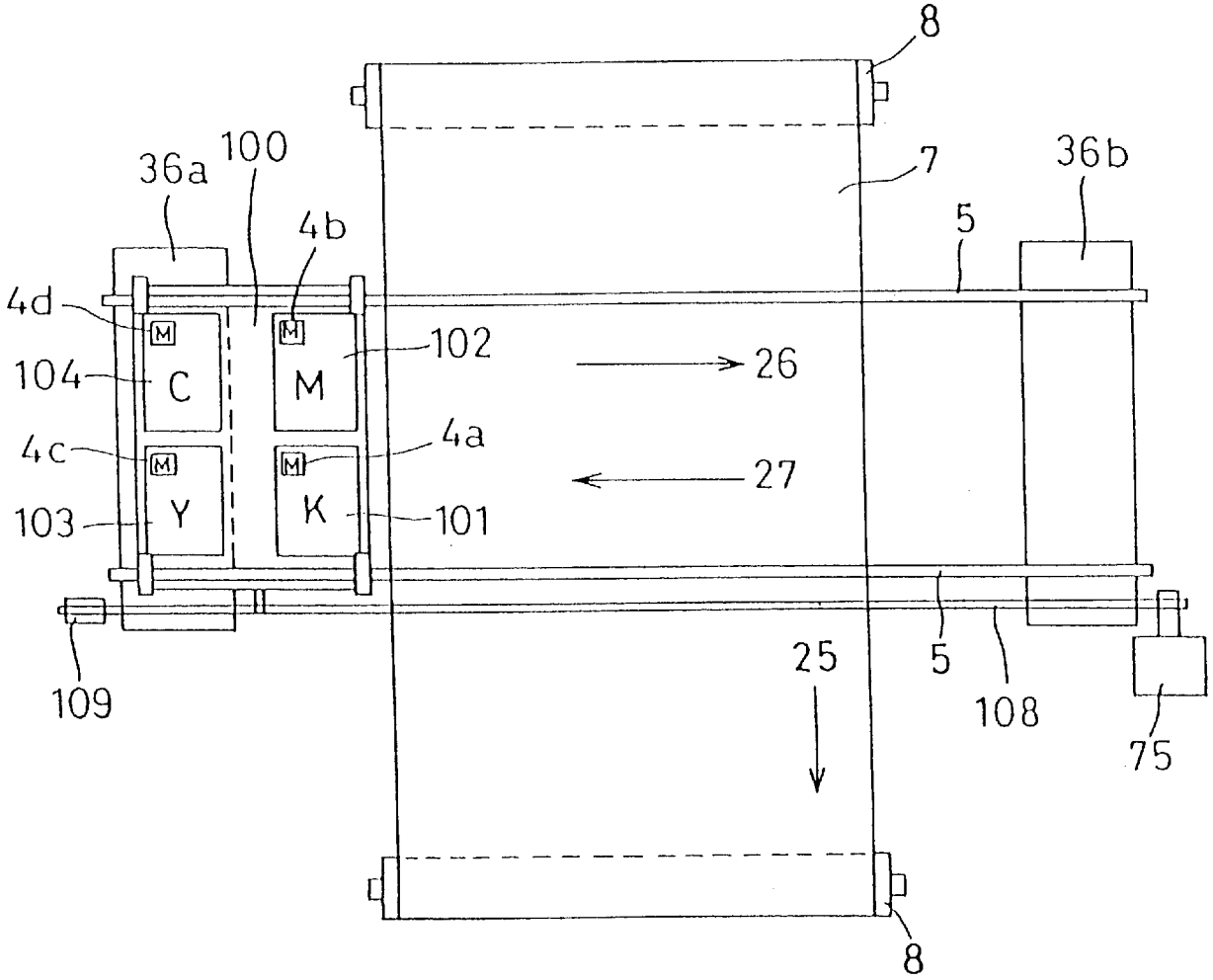
FIG. 18 is a plan view showing a schematic structure of the embodiment in FIG. 17.

FIGS. 17 and 18 show a schematic structure of a powder-flying recording apparatus of still another embodiment of the present invention. FIG. 17 shows the schematic entire structure of the apparatus viewed from the right side of the apparatus and FIG. 18 shows an essential portion of the apparatus viewed from the upper side of the apparatus. A printing unit 100 of the recording apparatus of this embodiment can record color images. Developing agent units 101, 102, 103, and 104 for four colors are set to the printing unit 100 in the form of a planar arrangement like a 2×2 matrix as shown in FIG. 18. Color toners for black (K), magenta (M), yellow (Y), and cyan (C) are supplied from the developing agent units 101, 102, 103, and 104 provided with motors 4*a*, 4*b*, 4*c*, and 4*d* respectively. The structure of each of the developing agent units 101, 102, 103, and 104 is basically the same as that of the printing unit 1 shown in FIG. 2, and toner 107 is flown from the surfaces of the developing rollers 105, 106 which are rotatively driven by the motors 4*a*, 4*b*, through electric field control and attaches onto the transfer belt 7. A bias voltage is applied to the developing rollers 105 and 106 from a bias power supply 127. The toner 107 on the transfer belt 7 is transferred onto the recording paper 13 by the fixing device 55 due to the pressure of the rubber roller 47, fused due to the heat of the halogen lamp 46, and fixed as a toner image 107*a*. Fused toner 107*b* remaining on the transfer belt 7 removed by the blade 11 of the cleaning unit 10. Head cleaning units 36*a* and 36*b* for the developing agent units 103 and 104 and the developing agent units 101 and 102 are arranged at the both ends of the moving range of the printing unit 100 respectively.

Figure 19:
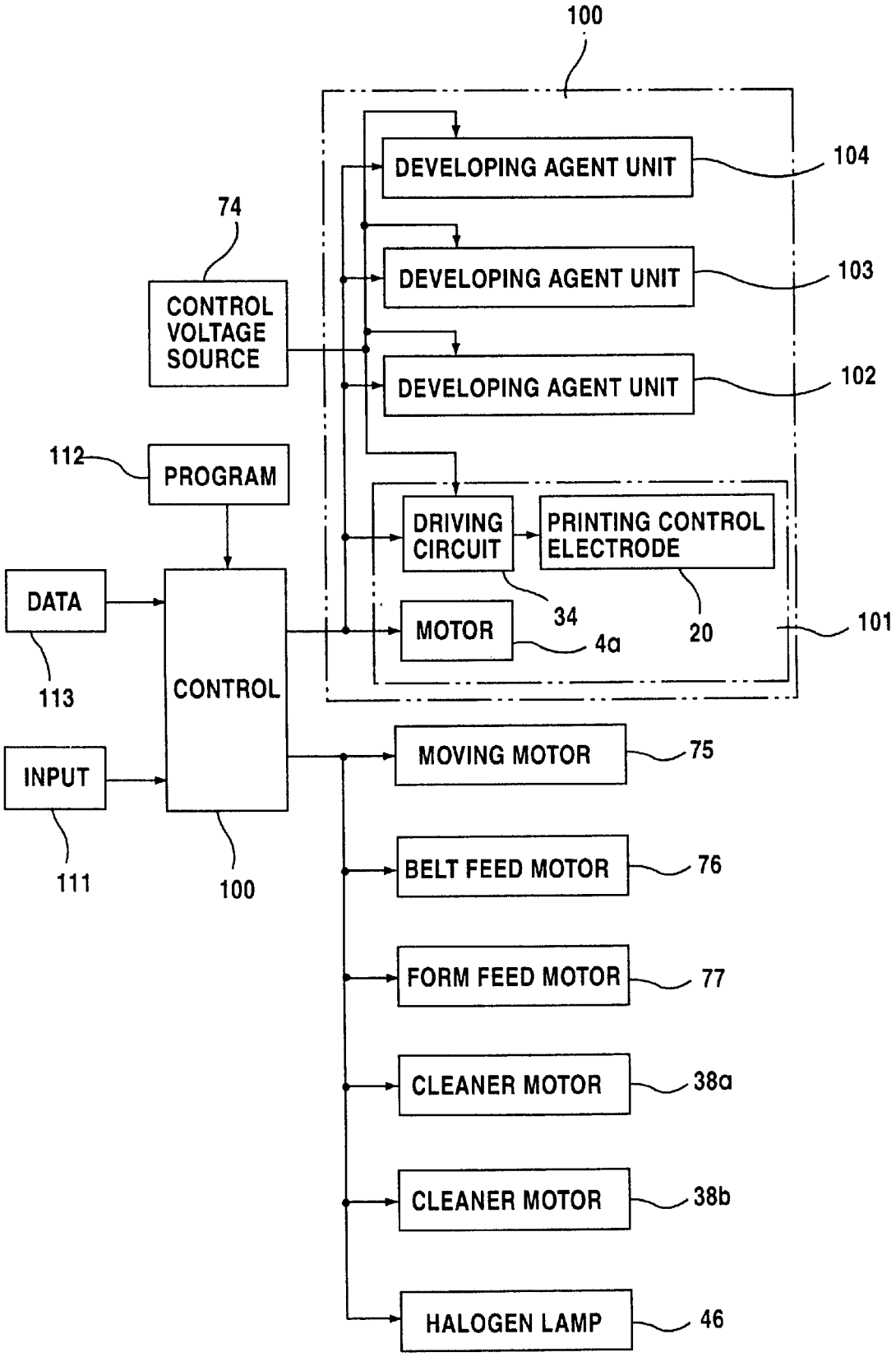
FIG. 19 is a block diagram showing a schematic electrical structure of the embodiment in FIG. 17.

FIG. 19 shows a schematic electrical structure of the embodiment in FIG. 17. A control circuit 110 including a microcomputer and the like supplies the data stored in a data memory 113 to the driving circuit 34 of each of the developing agent units 101, 102, 103, and 104 of the printing unit 100 in response to a command supplied to an input device 111 such as an operation switch in accordance with a program previously stored in a program memory 112. The driving circuit 34 changes a DC voltage supplied from the control voltage source 74 in accordance with data and supplies a changed voltage to the printing control electrode 20 to electric-field-control a toner flying condition. Moreover, the control circuit 110 drives the moving motor 75 for moving the printing unit 100, belt feed motor 76 for carrying the transfer belt 7, paper feed motor 77 for carrying the recording paper 13, cleaner motors 38*a* and 38*b* for cleaning a developing roller, halogen lamp 46 for heating the fixing device 16, and motors 4*a*, . . . of the developing agent units 101, 102, 103, and 104. Operations between these motors and the halogen lamp are synchronized in accordance with a program. Movement of the printing unit 100 by the moving motor 75 is performed by a driving belt 108 stretched along the guide shaft 5 similarly to the case of the printing unit 1 of the embodiment in FIG. 1. The driving belt 108 is a timing belt which is stretched between a pulley 109 and the moving motor 75. The moving motor 75, belt feed motor 76, and paper feed motor 77 respectively use, for example, a stepping motor and control an angular displacement value as digital data. Movement of the printing unit 100 to a specific position such as the origin or the position of the cleaning unit 36*a* or 36*b* is also detected by a previously-set sensor such as an optical interrupter.

A full-color image using toners 107 of four colors is recorded by combining two repetitions of movement of the printing unit 100 in the cross direction vertical to the carrying direction of the transfer belt 7 with two repetitions of carrying of the transfer belt 7 every length in the carrying direction of an image which can be printed by each of the developing agent units 101, 102, 103, and 104. By attaching the toner 107 of a necessary color to a position on the transfer belt 7 corresponding to each pixel of an image to be recorded in accordance with the data showing the image by synchronizing the movement of the printing unit 100 with the carrying of the transfer belt 7, it is possible to obtain a color image on the recording paper 13 by the fixing device 55. When a plurality of colors such as red and black less than full colors are necessary, it is necessary to use developing agent units equal to the number of necessary colors. Moreover, it is possible to use a developing agent unit dedicated to a color such as a fluorescent color or metallic color which cannot be realized by the normal full-color method.

Figure 20:
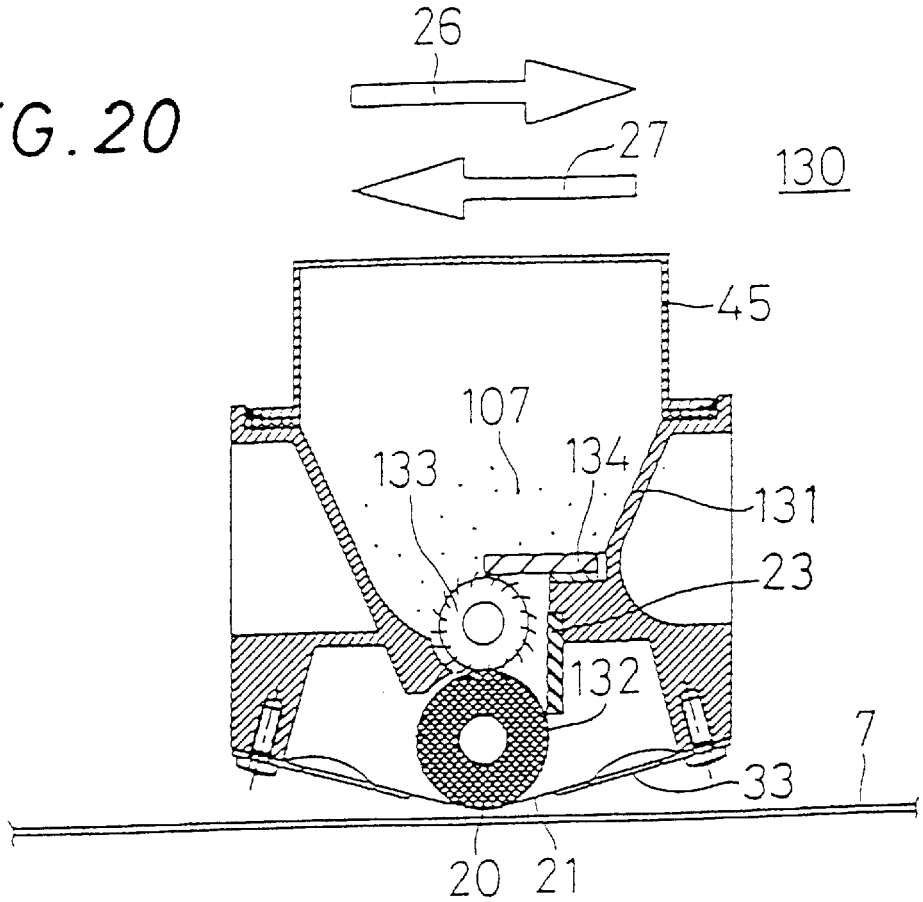
FIG. 20 is a front sectional view showing a schematic structure of a developing agent unit 130 of still another embodiment of the present invention.

FIG. 20 shows a schematic structure of a developing agent unit 130 used for still another embodiment of the present invention. This embodiment feeds the nonmagnetic toner 107 to a developing roller 132 facing the bottom opening of a toner vessel 131 while electrifying the toner 107 by a feed roller 133 flocked with conductive fibers so as to be suitable for the toner 107. Extra toner 107 is controlled by a blade 134.

Figure 21A:
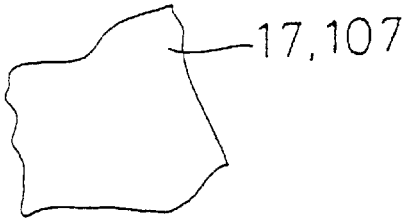
FIGS. 21A and 21B are illustrations showing toner shapes used for each embodiment of the present invention.
Figure 21B:
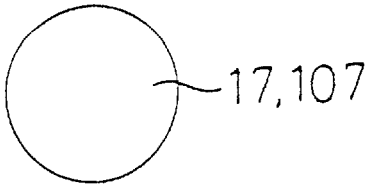

FIGS. 21A and 21B show shapes of the toners 17 and 107 used for each embodiment described above. Because the toner in FIG. 21A is made of a thermoplastic resin and manufactured by the crushing method, the surface of the toner is very rough. The toner in FIG. 21B is manufactured by the polymerization method and has an almost-spherical smooth shape. The embodiment in FIG. 17 uses the nonmagnetic toner 107.

Figure 22:
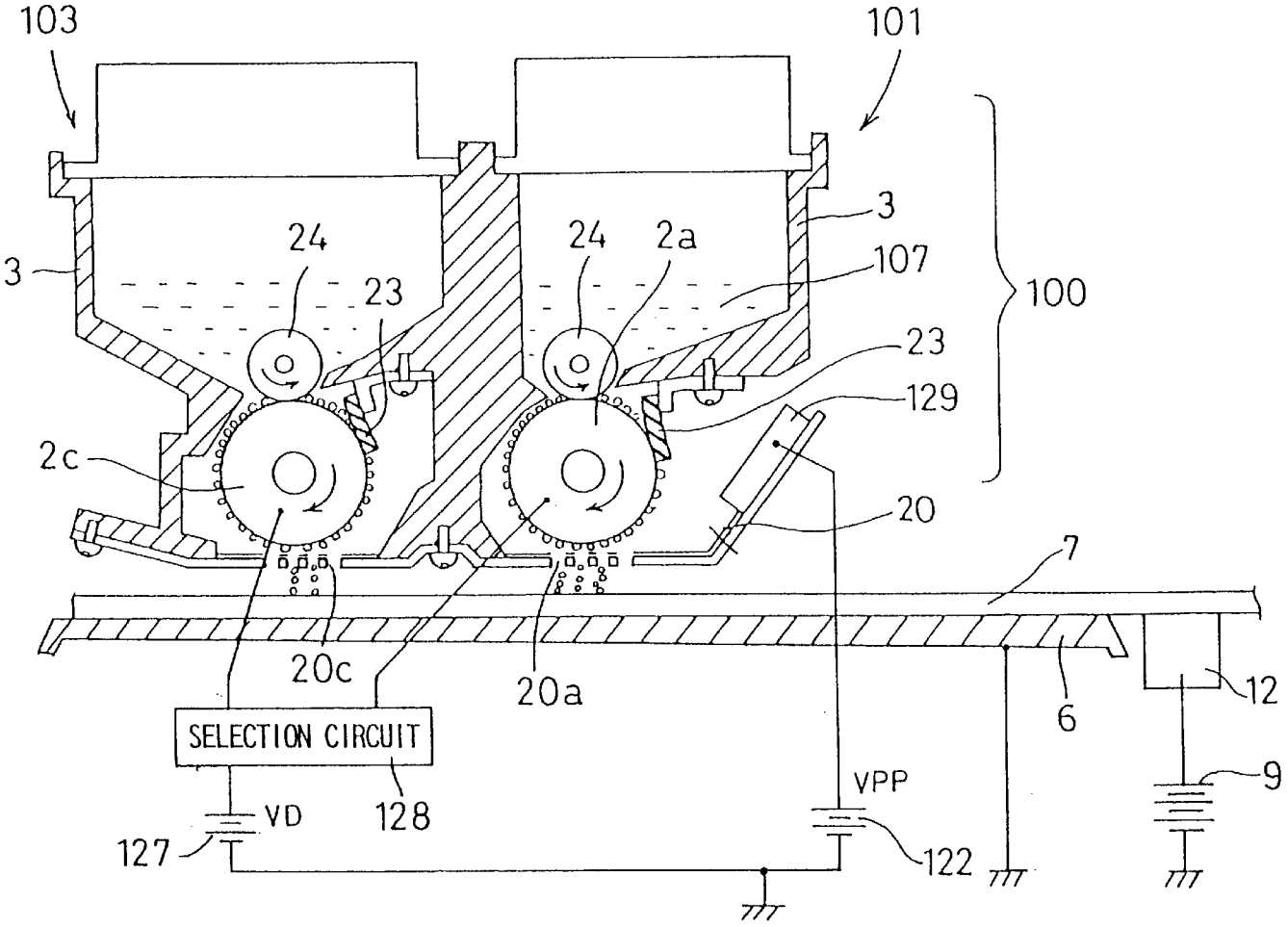
FIG. 22 is a right side view of a printing unit 100 of still another embodiment of the present invention.

As shown by still another embodiment of the present invention in FIG. 22, a bias voltage VD is selectively applied to developing rollers 2*a* and 2*c* of the developing agent units 101 and 103 from the bias voltage source 127 through a selection circuit 128. This bias voltage controls the flying amount of toner 107. When +300 V is applied to the printing control electrodes 20*a* and 20*c*, the flying amount of toner 107 increases by setting the bias voltage to 0 V and decreases by setting the bias voltage to approx. +200 V. By applying a printing control voltage VPP to the corresponding printing control electrodes 20*a* and 20*c* in the developing agent units 103 and 101 in parallel from a control voltage source 122 through a driving circuit 129 and selectively controlling the bias voltage to be applied to the developing rollers 2*a* and 2*c*, it is possible to control the printing operations of the developing agent units 101 and 103 by the matrix method.

Figure 23:
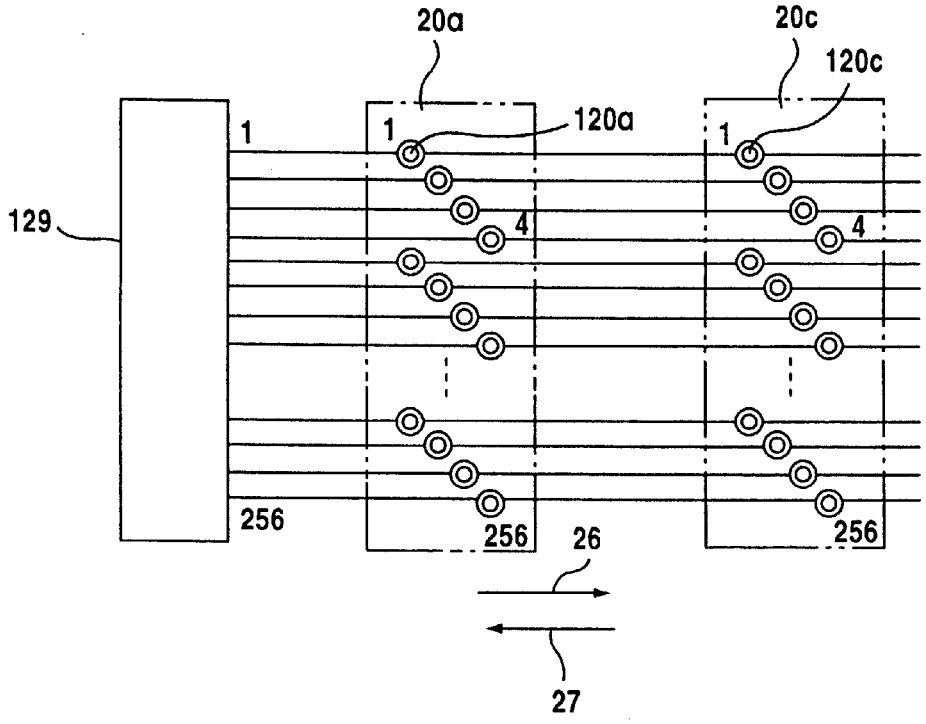
FIG. 23 is a plan view showing a schematic structures of printing control electrodes 20*a* and 20*c* of the embodiment in FIG. 22.

The printing control electrodes 20*a* and 20*c*, as shown in FIG. 23, relate to electrode holes 120*a* and 120*b* at corresponding positions in the developing agent units 101 and 103 and are driven in parallel by the driving circuit 129. Two hundred and fifty six electrode holes 120*a* and the same number of electrode holes 120*b* are drilled for each of colors C, Y, M, and K. To increase the printing density, the electrode holes 120*a* and 120*b* are arranged diagonally to the moving directions 26 and 27 of the printing unit 100 and the diameter of the holes is set to a value slightly larger than the outside diameter of the toner 107, for example, to 50 to 90 μm. The diameter is changed depending on the resolution of a print. Moreover, because the numbers of electrode holes 120*a* and 120*b* specify a width to be printed by one-time movement of the printing unit 1, this is the content to be changed depending on a printing speed. This embodiment uses 256 electrode holes/color.

Figure 24:
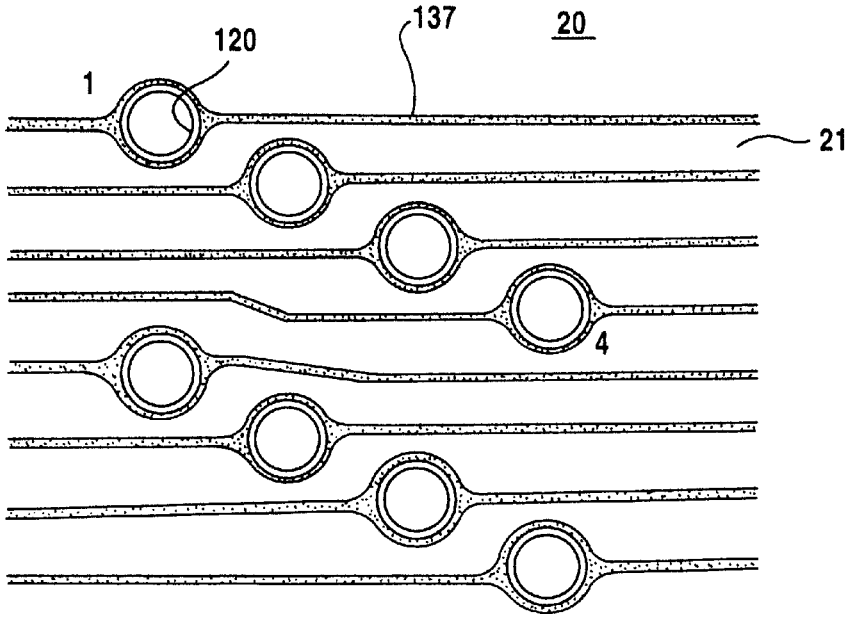
FIG. 24 is a partial plan view of a printing control electrode 20.
Figure 25:
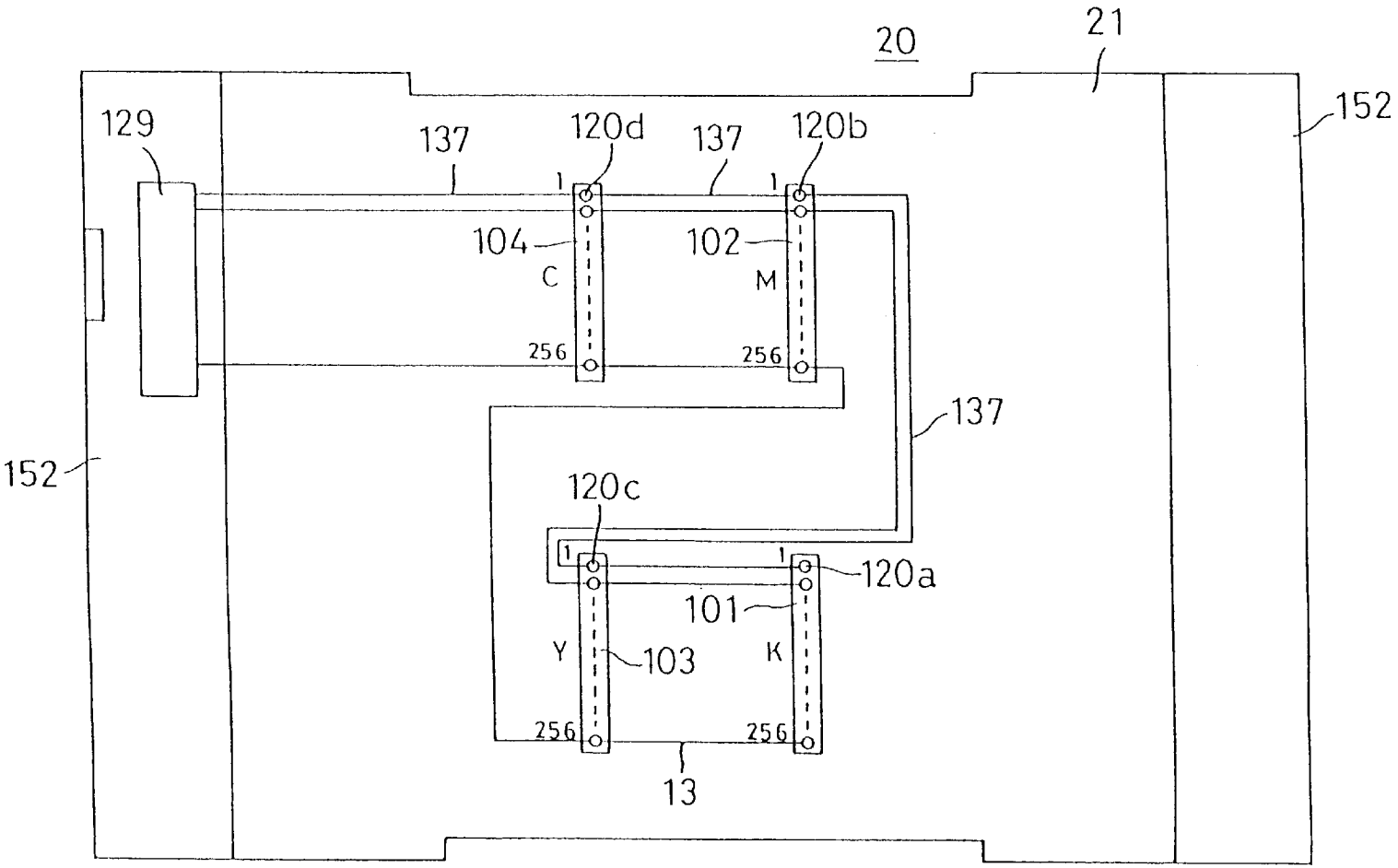
FIG. 25 is a plan view showing an example of the printing control electrode 20.
Figure 26:
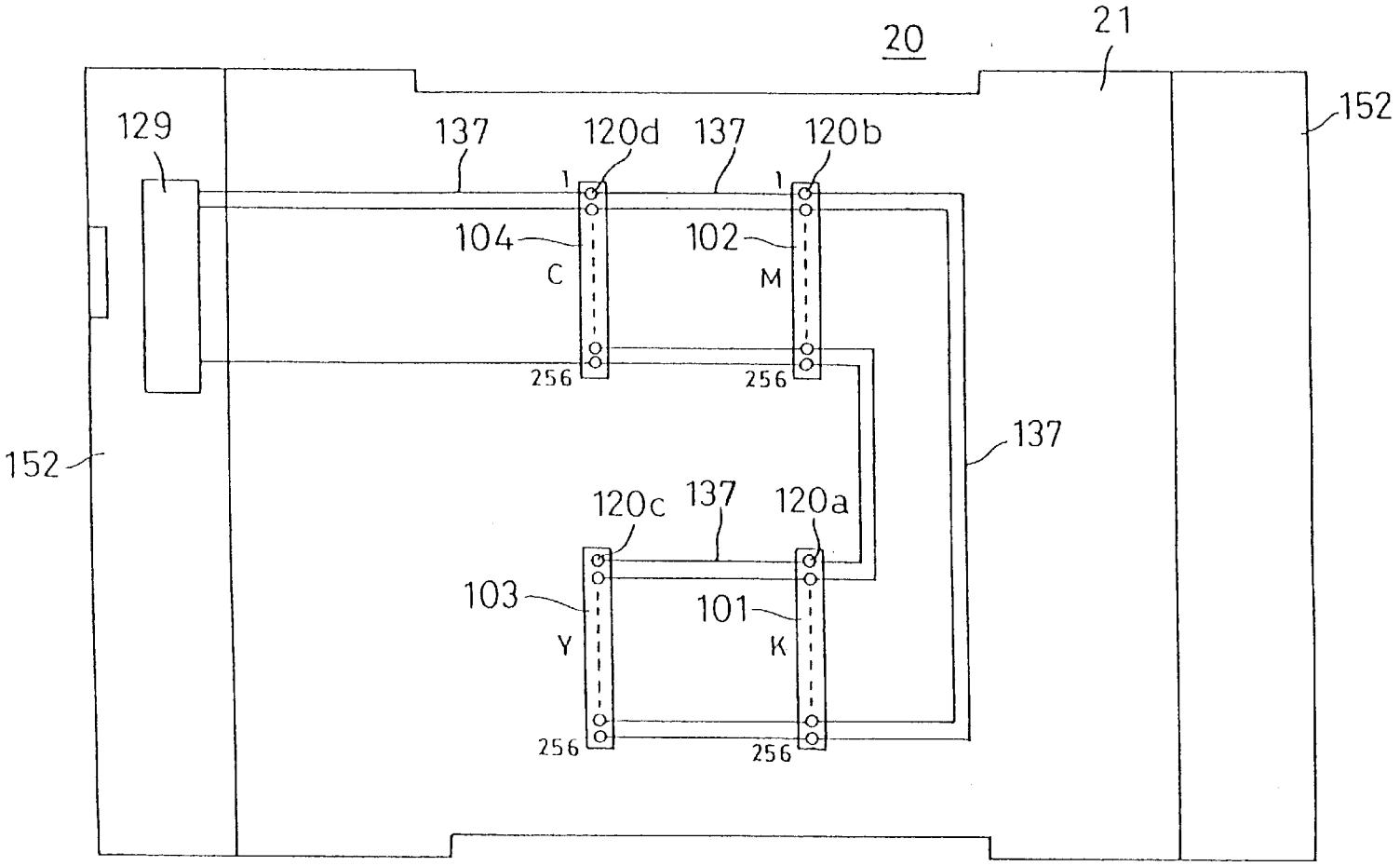
FIG. 26 is a plan view showing another example of the printing control electrode 20.

As shown in FIG. 24, a printing control electrode 20 of one color is formed by etching, for example, a copper foil on the FPC 21, which encloses an electrode hole 120 as a copper wire 137 and is connected to the output of the driving circuit 129. Moreover, in the case of electrode holes 120*a*, 120*b*, 120*c*, and 120*d*, the first electrode hole 120*a* in the developing agent unit 101 is connected to the first electrode holes 120*b*, 120*c*, and 120*d* in developing agent units 102, 103, and 104 as shown in FIG. 26. Hereafter similarly, up to the 256th electrode holes are connected. Furthermore, in the case of the connection between the electrode holes 120*a*, 120*c* and the electrode holes 120*b*, 120*d*, it is possible to connect the first electrode hole with the 256th electrode hole by changing the sequence between the developing agent units 101, 103 and the developing agent units 102, 104 as shown in FIG. 26. The driving circuit 129 is mounted on a hard printed circuit board 152 and united as one printed circuit board as a whole to decrease the area used by the FPC 21.

Figure 27:
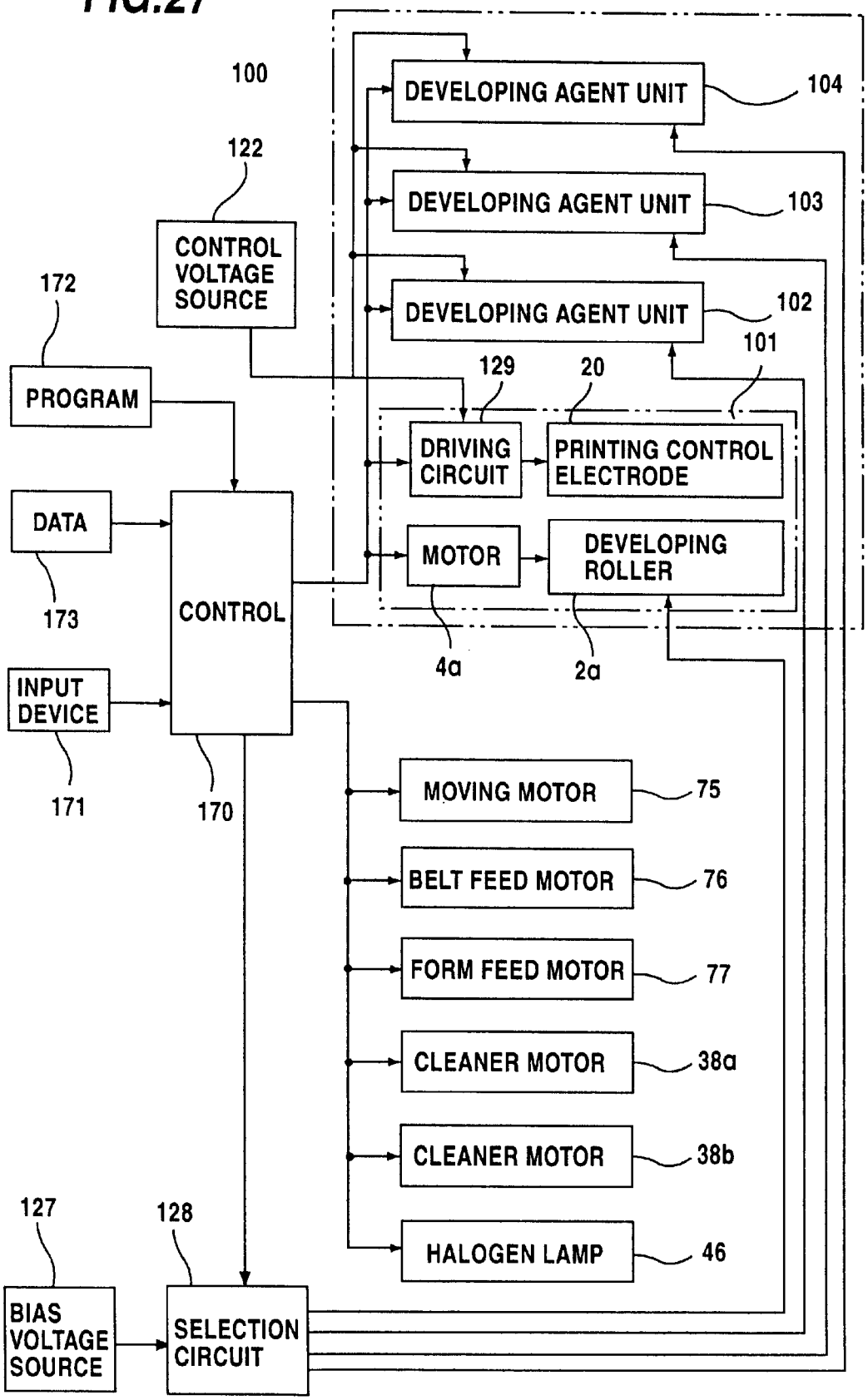
FIG. 27 is a block diagram showing a schematic electrical structure of the embodiment in FIG. 17.

FIG. 27 shows a schematic electrical structure of the embodiment in FIG. 22. A control circuit 170 including a microcomputer and the like supplies the data stored in a data memory 173 to the driving circuit 129 of the printing unit 100 in response to a command supplied to an input device 171 such as an operation switch in accordance with a program previously stored in a program memory 172. The driving circuit 129 changes a voltage of approx. +300 V supplied from the control voltage source 122 in accordance with data to apply a changed voltage to the printing control electrode 20 and electrical-field-control the flying state of the toner 107. Moreover, the control circuit 170 controls the moving motor 75 for moving the printing unit 100, belt feed motor 76 for carrying the transfer belt 7, paper feed motor 77 for carrying the recording paper 13, cleaner motors 38*a* and 38*b* of the head cleaning units 36*a* and 36*b* for cleaning a developing roller, halogen lamp 46 for heating the fixing device 16, and motors 4*a*, . . . for rotating the developing roller 2*a*, . . . for each of developing agent units 101, 102, 103, and 104.

Operations between these motors and the halogen lamp are synchronized in accordance with the program stored in the program memory 172 in FIG. 27. Movement of the printing unit 100 by the moving motor 75 is performed by a driving belt stretched along the guide shaft 5. The moving motor 75, belt feed motor 76, and form feed motor 77 respectively use, for example, a stepping motor and control an angular displacement value as digital data.

Figure 28:
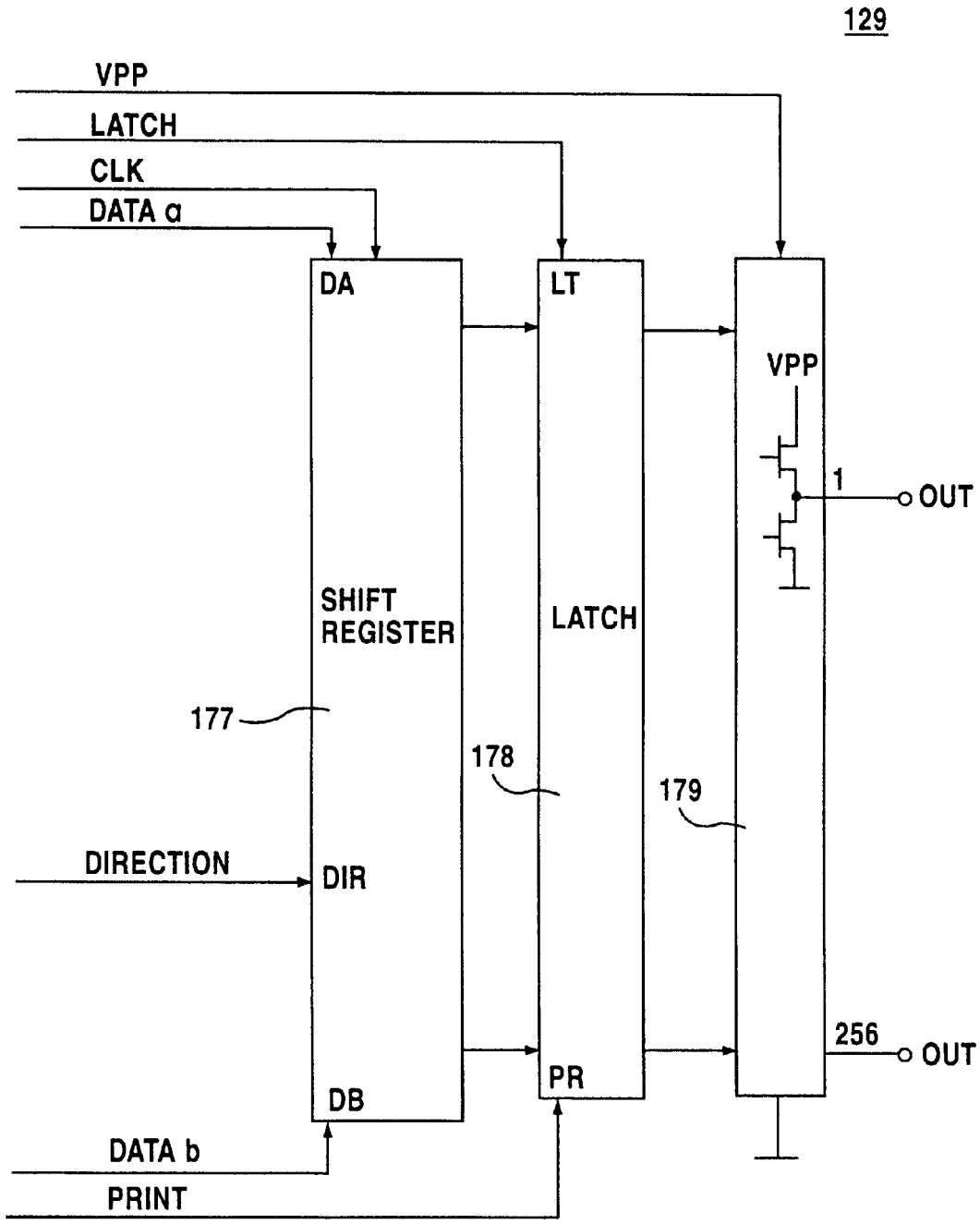
FIG. 28 is a block diagram of a driving circuit 129 of the embodiment in FIG. 17.

FIG. 28 shows the structure of the driving circuit 129. The driving circuit 129 has a shift register 177, a latch 178, and a driver 179. The printing control voltage VPP is applied to the driver 179 from the control voltage source 122. A latch signal LATCH and a clock signal CLK are supplied to the latch 178 and the shift register 177 respectively. By supplying data DATA a and data DATA b to two data inputs DA and DB respectively, the shift register 177 switches the direction from DA to DB and the direction from DB to DA in accordance with a direction designating signal DIRECTION supplied to a direction designating input DIR. The input data sequentially shifts in accordance with the clock signal CLK. When 256 clock signals CLK are input, the data input in accordance with the latch signal LATCH are temporarily stored in the latch 178. Thereafter, when a print signal PRINT is input, the driver 179 performs the switching operation of ON/OFF depending on the content according to the latched data and a printing control voltage is output to an output terminal OUT. This output is connected to the copper wire 137 around the electrode holes 120 for various colors to control the flying of the toner 107 as shown in FIG. 24.

Figure 29:
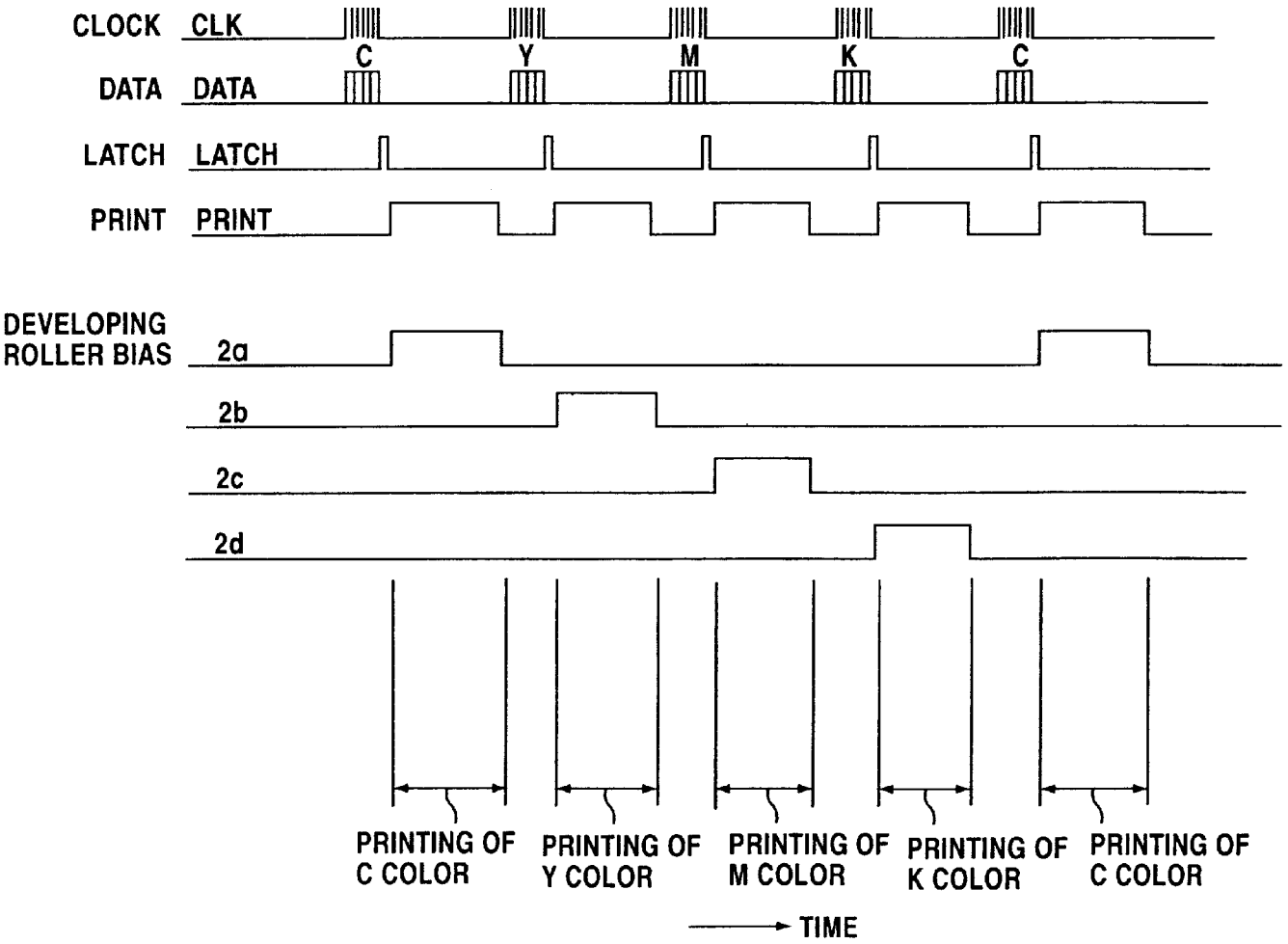
FIG. 29 is a time chart showing a printing operation of the embodiment in FIG. 17.

FIG. 29 shows the printing timing of the printing unit 100 of the embodiment in FIG. 22. Data DATA to be printed are sequentially captured by the shift register 177 in FIG. 28 and shifted in accordance with the clock signal CLK and outputs of the shift register are captured by the latch 178 in parallel in accordance with the latch signal LATCH. The driver 179 perform the switching operation of ON/OFF in accordance with the data output from the latch 178 by the print signal PRINT and a printing control voltage is applied to each printing control electrode. A bias voltage for selecting one of the developing rollers 2*a,* 2*b,* 2*c,* and 2*d* is supplied from the selection circuit 128 in FIG. 27 and thereby, cyan (C), yellow (Y), magenta (M), and black (K) are printed in order.

Figure 30:
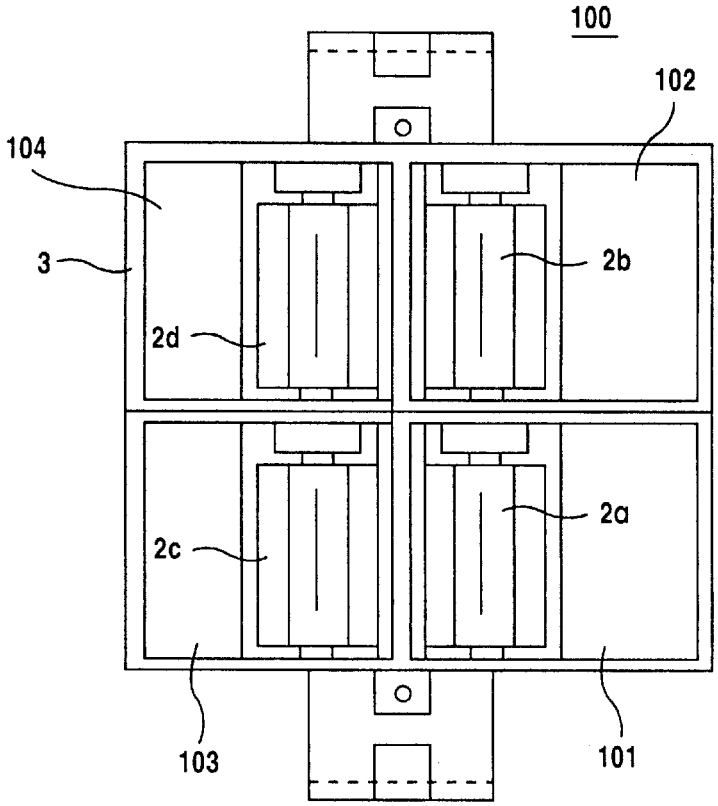
FIG. 30 is a simplified plan sectional view of the printing unit 100 of the embodiment in FIG. 17.
Figure 31:
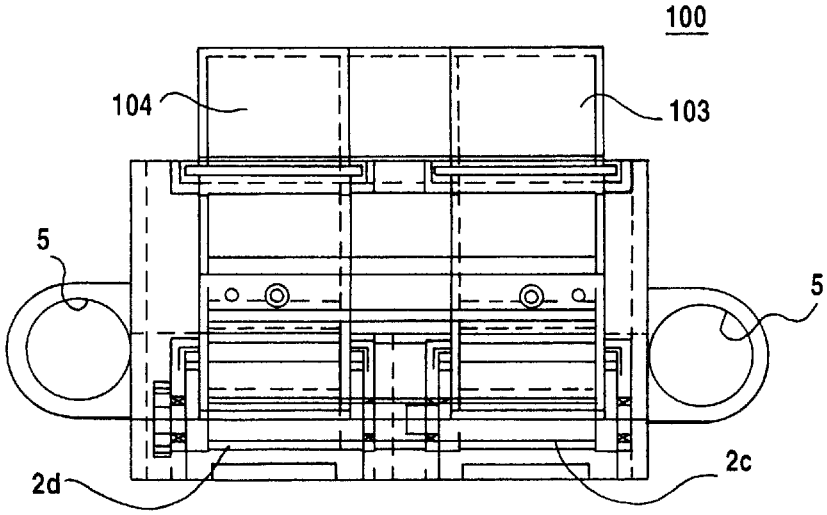
FIG. 31 is a simplified left-side sectional view of the printing unit 100.
Figure 32:
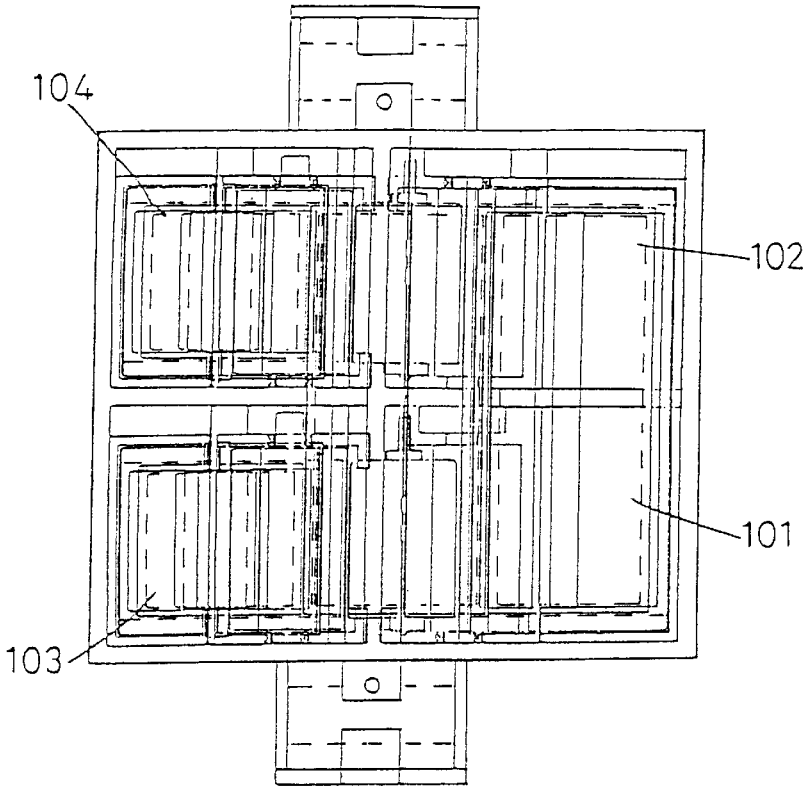
FIG. 32 is a plan view of the printing unit 100.
Figure 33:
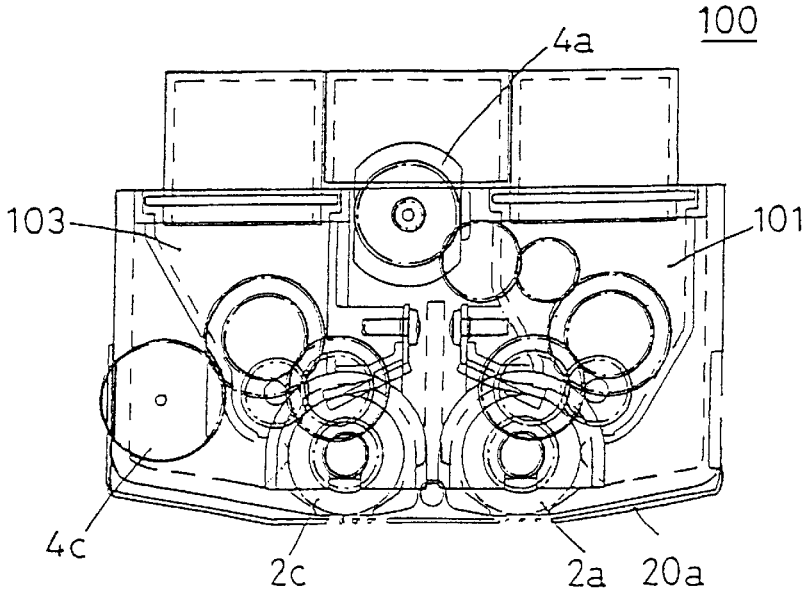
FIG. 33 is a left-side sectional view of the printing unit 100.

FIGS. 30 and 31 show a simplified plan view and a simplified left-side sectional view of the printing unit 100 respectively. FIGS. 32 and 33 show a plan view and a front sectional view of the printing unit 100 respectively.

Figure 34:
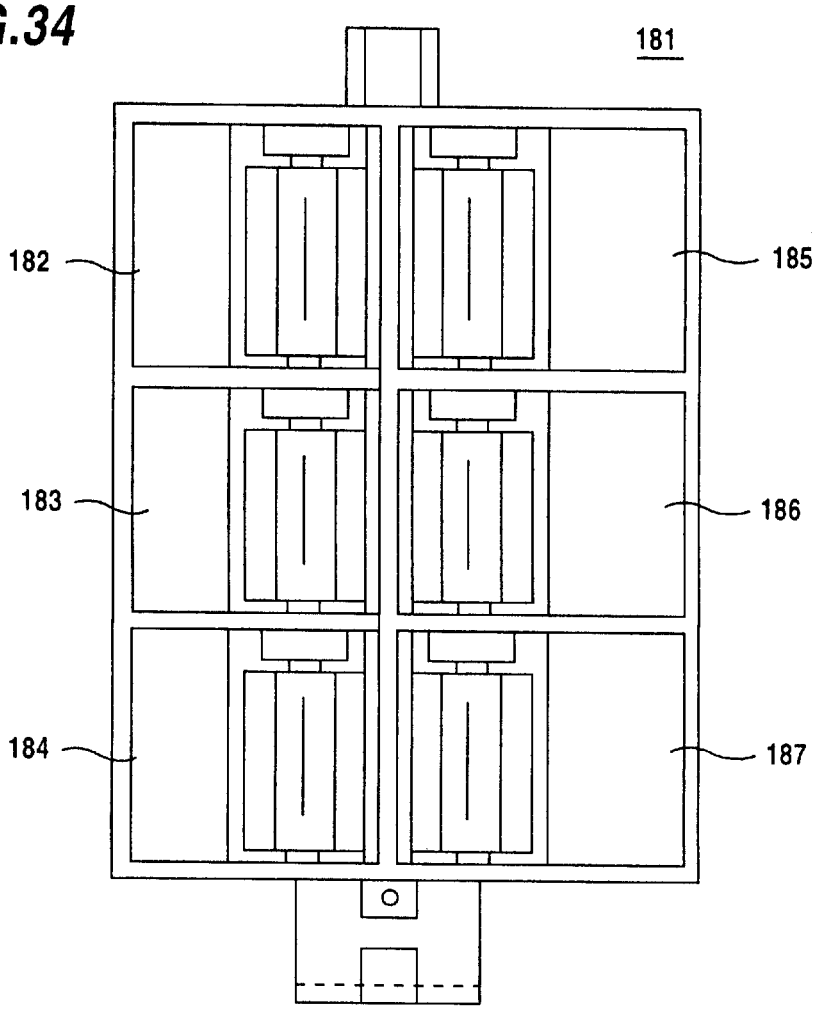
FIG. 34 is a simplified plan view showing a schematic structure of a printing head 181 of still another embodiment of the present invention.
Figure 35:
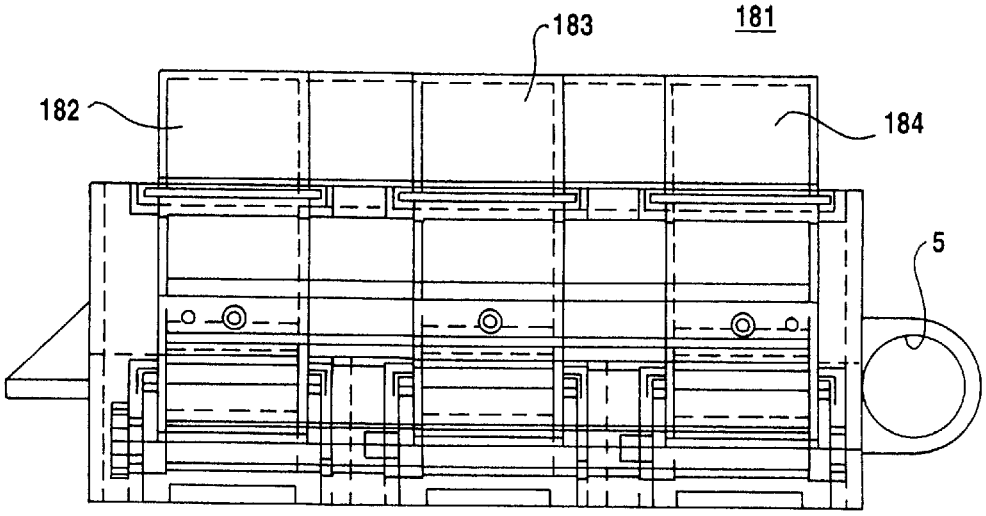
FIG. 35 is a left-side sectional view of the printing head 181.
Figure 36:
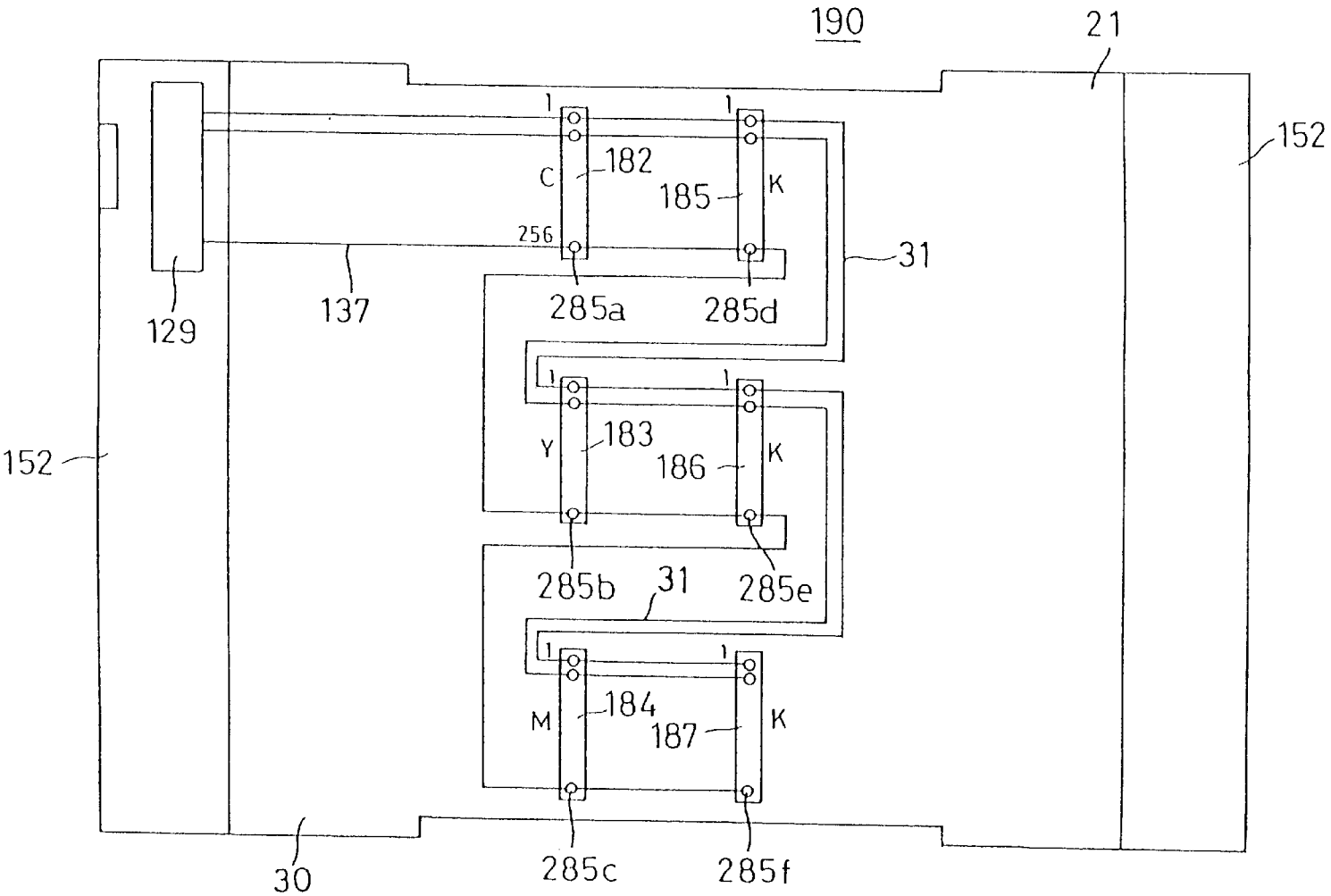
FIG. 36 is a plan view of a printing control electrode 190 of the embodiment in FIG. 34.

FIGS. 34 and 35 show a simplified plan view and a simplified left-side sectional view of a printing unit 181. This embodiment is provided with the line of developing agent units 182, 183, and 184 for cyan (C), yellow (Y), and magenta (M) and the line of three developing agent units 185, 186, and 187 for black (K) in the direction vertical to the moving direction of the printing unit 181. It is possible to print black at a speed three times larger than the printing speed of other colors and therefore, it is possible to efficiently use the black printing when monochromatic printing is frequency used. FIG. 36 shows the structure of the printing control electrode 190. Electrode holes 285*a,* 285*b,* 285*c,* 285*d,* 285*e,* and 285*f* are connected in parallel on six developing agent units 182, 183, 184, 185, 186, and 187 in the same sequence and the output of the driving circuit 129 is supplied.

Figure 37:
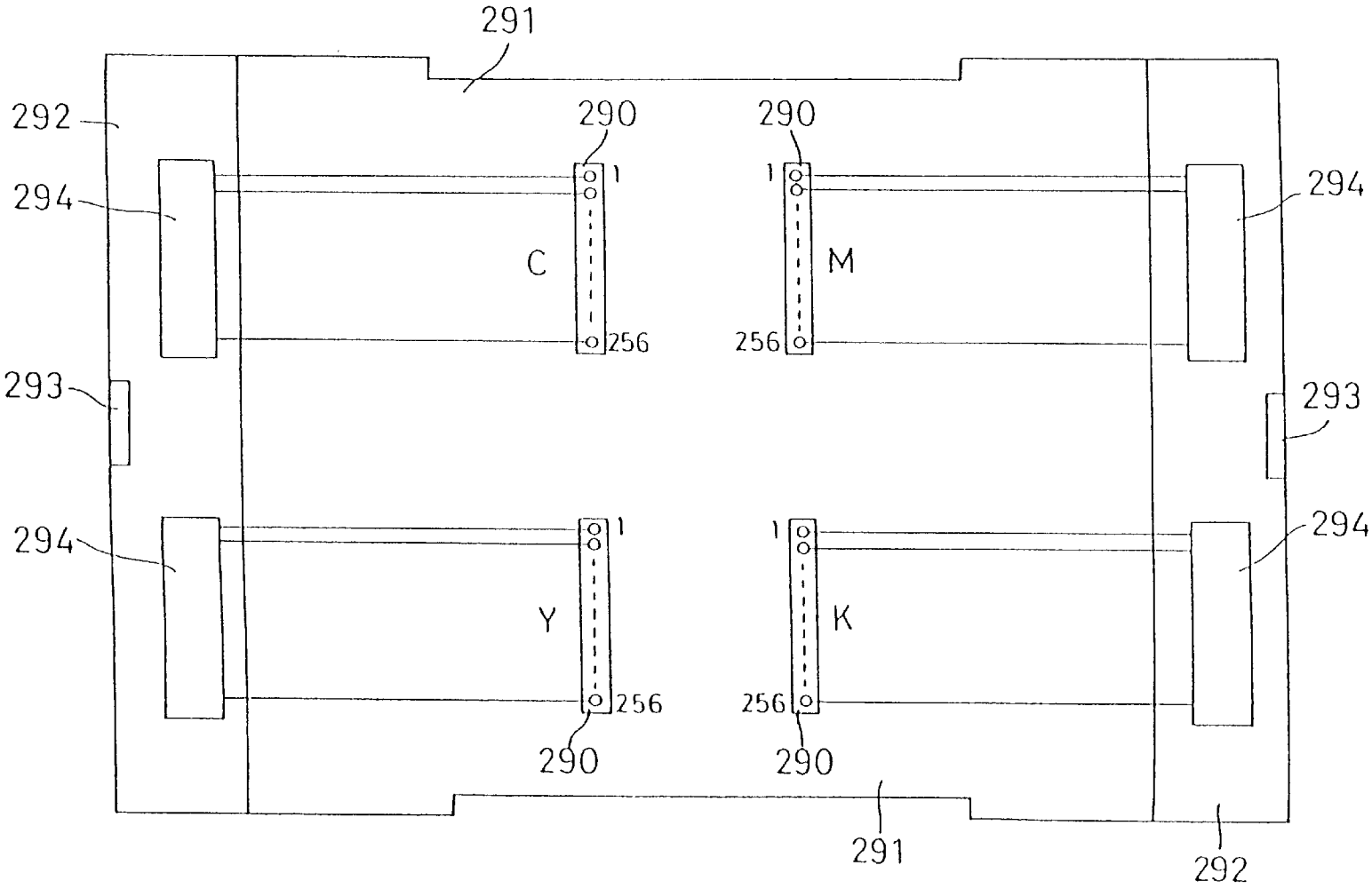
FIG. 37 is a plan view of a conventional printing control electrode.

The conventional printing control electrode shown in FIG. 37 does not perform matrix drive.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A powder-projecting type recording apparatus comprising:

a printing unit provided with a developing agent carrier for holding powdered developing agents and a printing control electrode for projecting the developing agents through holes formed in the printing control electrode to create developing agent projectiles;

an endless seamless belt-like movable transfer medium having a uniform thickness for accelerating the developing agent projectiles projected from the printing unit to form an image by the developing agents on a surface of the transfer medium; and transfer means set at a downstream side of the printing unit for transferring the image formed on the surface of the transfer medium with the developing agents onto a recording member.

2. The powder-projecting type recording apparatus of claim 1, wherein the transfer medium is an acceleration electrode which moves and functions as an acceleration electrode for accelerating the developing agent projectiles.

3. The powder-projecting type recording apparatus of claim 1, wherein the transfer means transfers and simultaneously fixes the image formed on the transfer medium with the use of the developing agents onto the recording member by heating and pressuring the developing agents.

4. The powder-projecting type recording apparatus of claim 1, wherein the transfer medium is electrically conductive.

5. The powder-projecting type recording apparatus of claim 1, wherein the developing agent is a nonmagnetic toner.

6. The powder-projecting type recording apparatus of claim 1 further comprising:

cleaning means for cleaning extra developing agents which are attached to or adjacent to the printing control electrodes provided at an end of a moving range of the printing unit.

7. The powder-projecting type recording apparatus of claim 6, wherein the cleaning means is a rotating brush roller having a brush made of fiber around the roller and the brush fiber is semiconductive.

8. The powder-projecting type recording apparatus of claim 1, wherein the developing agent carrier is provided with:

a hopper for storing the developing agents;

a developing roller for moving the developing agents in the hopper up to a vicinity of the printing control electrode by attaching the developing agent to a surface of the developing roller; and a motor for rotatively driving the developing roller.

9. The powder-projecting type recording apparatus of claim 1, the apparatus further comprising:

printing control means in which a plurality of sets of the printing units are arranged and printing control electrodes are connected so as to be in parallel in accordance with a predetermined combination between printing units to apply a printing control voltage to every combination of printing control electrodes connected in parallel; and selecting and driving means for selecting a set of developing agent carriers out of the developing agent carriers of a plurality of sets of printing units and applying a bias voltage which allows a developing agent to be projected by applying a printing control voltage to a printing control electrode.

10. The powder-projecting type recording apparatus of claim 9, wherein developing agent units for four colors of cyan, magenta, yellow, and black are arranged on the printing unit in a 2×2 matrix form as a whole so that two units are arranged in one of two lines which are separated in the moving direction.

11. The powder-projecting type recording apparatus of claim 10, wherein the printing control electrodes of the plurality of sets of the printing units are formed on the same printed circuit board and the printing control means is mounted on the printed circuit board.

12. The powder-projecting type recording apparatus of claim 9, wherein a total of six developing agent units for four colors of cyan, magenta, yellow and black are arranged in the printing unit of the invention in two lines which are separated in the moving direction so that three units are arranged in each line, and cyan, magenta, and yellow are assigned to the three units of one of the two lines, respectively, and black is assigned to three units of the other line.

13. The powder-projecting type recording apparatus of claim 12, wherein the printing control electrodes of the plurality of sets of the printing units are formed on the same printed circuit board and the printing control means is mounted on the printed circuit board.

14. The powder-projecting type recording apparatus of claim 1, further comprising:

a fixed base electrode plate, separated from the printing control electrodes by a predetermined distance, keeping the transfer medium flat; and carrying means for carrying the transfer medium; wherein said printing unit is movable to reciprocate in a range of a predetermined recording width, and said carrying means carries the transfer medium in a direction perpendicular to a moving direction of the printing unit in synchronization with movement of the printing unit.

15. The powder-projecting type recording apparatus of claim 1, further comprising:

a hopper storing the developing agents, wherein the hopper and the printing unit are located on the same side of the transfer medium.

16. A printing method, comprising the steps of:

(a) projecting developing agents through holes formed in a printing control electrode to create developing agent projectiles;

(b) forming an image on a surface of a transfer medium as a result of the developing agent projectiles impinging the surface of the transfer medium; and (c) transferring the image formed on the surface of the transfer medium onto a recording member.

17. The printing method of claim 16, wherein step (b) includes forming the image on a surface of a moveable endless belt and step (c) includes transferring the image formed on the surface of the moveable endless belt onto a recording member.

18. The printing method of claim 16, wherein step (b) includes accelerating the developing agent projectiles using an electric field resulting from charging an electrically conductive element of said transfer medium.

* * * * *